US007333080B2

(12) United States Patent
Miller et al.

(10) Patent No.: US 7,333,080 B2
(45) Date of Patent: Feb. 19, 2008

(54) COLOR OLED DISPLAY WITH IMPROVED POWER EFFICIENCY

(75) Inventors: Michael E. Miller, Honeoye Falls, NY (US); Michael J. Murdoch, Rochester, NY (US); Ronald S. Cok, Rochester, NY (US); Andrew D. Arnold, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 564 days.

(21) Appl. No.: 10/812,787

(22) Filed: Mar. 29, 2004

(65) Prior Publication Data

US 2005/0212728 A1 Sep. 29, 2005

(51) Int. Cl.
*G09G 3/32* (2006.01)

(52) U.S. Cl. ..... 345/83; 345/694

(58) Field of Classification Search ..... 345/83, 345/677, 694, 695, 589
See application file for complete search history.

(56) References Cited

U.S. PATENT DOCUMENTS 3,813,686 A 5/1974 Mierwinski
4,800,375 A 1/1989 Silverstein et al.
5,233,385 A 8/1993 Sampsell
5,526,016 A 6/1996 Nakagiri et al.
5,563,621 A 10/1996 Silsby
5,638,084 A 6/1997 Kalt
5,929,843 A 7/1999 Tanioka
6,075,514 A 6/2000 Ryan
6,097,367 A * 8/2000 Kuriwaki et al. ..... 345/589
6,133,692 A 10/2000 Xu et al.
6,262,710 B1 7/2001 Smith
6,320,325 B1 11/2001 Cok et al.
6,366,025 B1 * 4/2002 Yamada ..... 315/169.3
6,366,077 B1 * 4/2002 Kim ..... 324/177
6,388,644 B1 5/2002 DeZwart et al.
6,411,306 B1 6/2002 Miller et al.
6,453,067 B1 9/2002 Morgan et al.
6,483,245 B1 11/2002 Weindorf et al.
6,498,952 B2 12/2002 Matthies
6,570,584 B1 * 5/2003 Cok et al. ..... 345/690
6,693,611 B1 * 2/2004 Burroughes ..... 345/83

(Continued)

FOREIGN PATENT DOCUMENTS

EP 830032 3/2002

(Continued)

*Primary Examiner*—Amr A. Awad
*Assistant Examiner*—Randal L Willis
(74) *Attorney, Agent, or Firm*—Andrew J. Anderson

(57) ABSTRACT

An OLED display device includes: an array of light emitting pixels, each pixel having red, green, and blue OLEDs and at least one additional colored OLED that expands the gamut of the display device relative to the gamut defined by the red, green and blue OLEDs, wherein the luminance efficiency or the luminance stability over time of the additional OLED is higher than the luminance efficiency or the luminance stability over time of at least one of the red, green, and blue OLEDs; and means for selectively driving the OLEDs with a drive signal to reduce overall power usage or extend the lifetime of the display while maintaining display color accuracy. In accordance with various embodiments, the present invention provides a color display device with improved power efficiency, longer overall lifetime, expanded color gamut with accurate hues, and improved spatial image quality.

38 Claims, 13 Drawing Sheets

U.S. PATENT DOCUMENTS

| | | | | |
|---|---|---|---|---|
| 6,950,115 | B2 * | 9/2005 | Brown Elliott | 345/694 |
| 2002/0015110 | A1 | 2/2002 | Elliott | |
| 2002/0024618 | A1 | 2/2002 | Imai | |
| 2002/0135312 | A1 * | 9/2002 | Koyama | 315/169.3 |
| 2002/0186214 | A1 | 12/2002 | Siwinski | |
| 2002/0191130 | A1 | 12/2002 | Liang et al. | |
| 2002/0196208 | A1 | 12/2002 | Nano et al. | |
| 2003/0011613 | A1 | 1/2003 | Booth, Jr. | |
| 2003/0103058 | A1 | 6/2003 | Elliott et al. | |
| 2004/0051724 | A1 | 3/2004 | Elliott et al. | |
| 2004/0113875 | A1 | 6/2004 | Miller et al. | |
| 2004/0178743 | A1 | 9/2004 | Miller et al. | |
| 2004/0178973 | A1 | 9/2004 | Miller et al. | |
| 2004/0178974 | A1 | 9/2004 | Miller et al. | |
| 2004/0195963 | A1 | 10/2004 | Choi et al. | |
| 2004/0222999 | A1 | 11/2004 | Choi et al. | |
| 2006/0044226 | A1 | 3/2006 | Liedenbaum et al. | |

FOREIGN PATENT DOCUMENTS

| | | |
|---|---|---|
| EP | 1 391 918 | 2/2004 |
| JP | 10/254386 | 9/1998 |
| JP | 2000/200061 | 7/2000 |
| WO | 00/11728 | 3/2000 |
| WO | 00/70400 | 11/2000 |
| WO | 01/99195 | 12/2001 |
| WO | 02/099557 | 12/2002 |
| WO | 2004/036535 | 4/2004 |

* cited by examiner

COLOR OLED DISPLAY WITH IMPROVED POWER EFFICIENCY

FIELD OF THE INVENTION

The present invention relates to organic light emitting diode (OLED), full-color display devices and, more particularly, to OLED color displays with improved gamut and power efficiency.

BACKGROUND OF THE INVENTION

Color, digital image display devices are well known and are based upon a variety of technologies such as cathode ray tubes, liquid crystal and solid-state light emitters, such as Organic Light Emitting Diodes (OLEDs). In a common OLED display device, each display element or pixel, is composed of red, green, and blue colored OLEDs. By combining the illumination from each of these three OLEDs in an additive color system, a wide variety of colors can be achieved.

OLEDs may be used to generate color directly using organic materials that are doped to emit energy in desired portions of the electromagnetic spectrum. However, the known red and blue emissive materials do not have particularly high luminance efficiencies. However, materials with higher luminance efficiencies are known in the art. While power efficiency is always desirable, it is particularly desirable in portable applications because an inefficient display limits the time the device can be used before the power source is recharged. Portable applications may also require the display to be used in locations with high ambient illumination, requiring the display to provide imagery with a high luminance level to be useful, further increasing the power required to present adequate imagery.

When designing a display device, it is important to understand the colors that are perceived by a human observer and the human eye's sensitivity to these colors. FIG. 1 shows a 1931 CIE standard photopic sensitivity curve 2. This curve relates the relative efficiency of the human eye to convert electromagnetic energy to perceived brightness as a function of wavelength within the visible spectrum. Electromagnetic energy that is weighted by this curve is commonly referred to as luminance, an entity that correlates with perceived brightness under a broad range of viewing conditions.

Traditionally, display devices have been constructed from a triad of red, green, and blue light emitting elements. The peak wavelengths of these light emitting elements will typically be in the short wavelength portion of the visible spectrum (e.g., at or near point 4) for blue, the middle wavelength portion of the visible spectrum (e.g., at or near point 6) for green, and the long wavelength portion of the visible spectrum (e.g., at or near point 8) for red. If the relative radiant efficiency of these light emitting elements are similar and the fact that the eye is most sensitive to energy in the middle wavelength portion of the visible spectrum, the green light emitting element will typically have significantly higher luminance efficiency than the red or blue light emitting elements. However, this relationship may not always exist since it is plausible that the radiant efficiency of one of the light emitting elements can be significantly higher than the radiant efficiency of another light emitting element.

While one goal when designing an OLED display device is to minimize the power consumption by maximizing the efficiency of each OLED, a competing goal is to maximize the color gamut of a display device. FIG. 2 shows a CIE 1931 chromaticity diagram with the chromaticity coordinates of typical red 12, green 14 and blue 16 light emitting elements. The color gamut 18 may be defined by a triangle that connects these points within the chromaticity diagram. To improve the color gamut of the display device, the area within this triangle must be increased. To increase this color gamut, the peak wavelength of the blue light emitting element will typically be reduced, providing energy that is even shorter in wavelength and further reducing the eye's sensitivity to the radiant energy provided by the light emitting element. Similarly, to increase the color gamut, the peak wavelength of the red light emitting element must be increased, producing energy that is even longer in wavelength and further reducing the eye's sensitivity to the radiant energy provided by the light emitting element. For this reason, the goals of providing increased color gamut and reduced power consumption typically compete with one another.

Another important factor when designing a display device is that many of the colors that must be produced will be neutral or desaturated. That is, these colors will be plotted at or near the white point of the display when plotted on the CIE 1931 chromaticity diagram. For example, it is known that the predominant color on many graphic displays is white. This includes the backgrounds in many popular applications; including word processing applications, such as Microsoft Word, and operating systems, such as Microsoft Windows. Additionally, pictorial images tend to be composed of neutral or desaturated colors. This fact has also been shown in the prior art by various authors; including Yendrikhovskij, S. (2001) Computing Color Categories from Statistics of Natural Images in the Journal of Imaging Science and Technology, vol. 45, no. 5, pp. 409-417.

Therefore, to decrease the power consumption of a display device under typical use conditions, it is very important that colors near the white point of the display device consume as little power as possible. However, in a typical three-color display device, white and desaturated colors are produced by the addition of luminance from the red 12, green 14, and blue 16 light emitting elements. Since the red 12 and blue 16 light emitting elements typically have relatively low luminance efficiency, as discussed earlier, the power consumption of the display device will be near its maximum when displaying white or a desaturated color.

OLEDs formed from materials that are doped to produce different colors may also have significantly different luminance stabilities. That is, the change in luminance output that occurs over time may be significantly different for the different materials. Such different luminance stabilities can cause mismatched luminance efficiency changes to occur in the OLEDs over time, and limit the effective overall lifetime of the display device.

It is possible to utilize one or more additional light emitting elements in addition to red, green and blue elements. US2003/0011613 by Booth, Jan. 16, 2003, e.g., describes a display device with red, green, blue and cyan light emitting elements. This application discusses the fact that blue light emitting elements typically have a lower luminance efficiency than a cyan emitter. This patent application also discusses the use of a three to four color conversion matrix to convert a three-color input signal to a four-color signal. Unfortunately, utilizing a three to four color conversion using a three to four color matrix as described will result in inaccurate and desaturated primary colors. The patent application also discusses using color conversion methods such as the ones used to employ three to four or more color conversion in inkjet printing. While this body of art discusses the use of several methods to convert from three to four or more colors, there is no discussion of utilizing information such as the efficiency of a single emitter to perform the color conversion in a way that will result in lower power consumption while maintaining accurate colors.

OLED display devices having other than red, green, and blue light emitting elements have also been discussed by others. For example, U.S. Pat. No. 6,570,584 by Cok, et al., May 27, 2003 describes OLED display devices having an additional cyan, yellow, and or magenta OLEDs that are utilized to increase the color gamut of the display device. While this patent does discuss the need to convert from an input three-color input signal to a four or more color signal, it does not describe a method to utilize these OLEDs in a way to reduce the power consumption of the display device.

US2002/0191130 by Liang et al, Dec. 19, 2002 discusses a display employing pairs of complementary colors (e.g., blue, yellow, red, and green). While this patent application does not discuss a method for providing color mixing, this display device structure enables the creation of flat white fields that employ all four light emitting elements. By providing flat white fields that employ all four light emitting elements per pixel, the display provides uniform areas of near-neutral colors. However, since this method utilizes all four light emitting elements in a pixel to produce white, power consumption is not necessarily reduced.

Display systems employing three to four color conversion are also known in the art of projection displays. For example, a method proposed by Morgan et al. in U.S. Pat. No. 6,453,067 issued Sep. 17, 2002, teaches an approach to calculating the intensity of the white primary dependent on the minimum of the red, green, and blue intensities, and subsequently calculating modified red, green, and blue intensities via scaling. Additionally, Tanioka in U.S. Pat. No. 5,929,843, issued Jul. 27, 1999 provides a method that follows an algorithm analogous to the familiar CMYK approach, assigning the minimum of the R, G, and B signals to the W signal and subtracting the same from each of the R, G, and B signals. To avoid contouring artifacts that may arise due to lack of gray scale resolution, the method teaches a variable scale factor applied to the minimum signal that results in smoother colors at low luminance levels. While each of these patents discuss three to four color conversion, neither provides a method to convert from three colors to three in-gamut colors and a fourth color that is outside a triangle connecting the color coordinates of the red, green, and blue emitters when plotted in a CIE chromaticity diagram. In fact, these algorithms cannot be utilized to produce an accurate color conversion when the display device provides a fourth, gamut-expanding primary color.

A method has been proposed by Ben-Chorin in WO 02/099557 filed on Dec. 12, 2002 for providing a color conversion from a three color signal to a signal usable for wide gamut display device employing more than three primary colors. The method described, however, does not provide a means for providing this conversion in a way to reduce the power consumption or extend the lifetime of an OLED display device. The method is also inflexible in response to changing display conditions.

While Booth, US2003/0011613; Cok et al, U.S. Pat. No. 6,570,584; and Liang et al., US2002/0191130 all discuss OLED display devices having four or more primary colors and discuss the need for a three to four color conversion process, the fact that flat fields of color may be created using three or fewer of the four light emitting elements is not discussed by these authors. Further, the fact that using only three of the four light emitting elements can produce flat fields of color that do not appear uniform in luminance is also not discussed. In fact, the prior art regarding four or more primaries does not appear to discuss the dynamic adjustment of the color conversion process in response to any other display or usage parameter.

There is a need, therefore, for an improved full-color OLED display device having improved power efficiency and/or overall lifetime while maintaining accurate hues. Ideally this display device will also provide expanded color gamut and improved spatial image quality.

SUMMARY OF THE INVENTION

In accordance with one embodiment, the present invention is directed towards a color OLED display device comprising: a) an array of light emitting pixels, each pixel having red, green, and blue OLEDs and at least one additional colored OLED that expands the gamut of the display device relative to the gamut defined by the red, green and blue OLEDs, wherein the luminance efficiency or the luminance stability over time of the additional OLED is higher than the luminance efficiency or the luminance stability over time of at least one of the red, green, and blue OLEDs; and b) means for selectively driving the OLEDs with a drive signal to reduce overall power usage or extend the lifetime of the display while maintaining display color accuracy.

In accordance with various embodiments, the present invention provides a color display device with improved power efficiency, longer overall lifetime, expanded color gamut with accurate hues, and improved spatial image quality.

DETAILED DESCRIPTION OF THE INVENTION

The present invention is directed to a full-color display device having a red, green, and blue OLED with one or more additional OLEDs that expand the color gamut, wherein the one or more additional OLEDs have a higher luminance efficiency or luminance stability over time than at least one of the red, green or blue OLEDs. A signal processor associated with the display converts a standard three-color image signal to drive signals that drive the OLEDs in a way as to reduce the power consumption of the display or extend the lifetime of the display as compared to the same display when all colors are formed using only the red, green, and blue OLEDs, while maintaining display color accuracy. This conversion process may be adjusted in response to use or display conditions.

The additional OLED is ideally positioned within the CIE chromaticity space such that its use may replace a less efficient OLED when forming a color at or near the white point of the display. By meeting this requirement, the inventors have demonstrated that the typical power savings can be increased from a savings on the order of 10 percent when the less efficient OLED does not eliminate the use of a less luminance efficient OLED when forming the most frequently occurring colors (those near white) to savings of more than 25 percent when the more efficient OLED eliminates the need to use a less efficient OLED to form the most frequently occurring colors.

The power consumption of the display device can therefore be reduced by introducing one or more additional light emitting elements with a higher luminance efficiency than one of the light emitting elements and the energy from this light emitting element may be used to reduce the use of one or more of the light emitting elements having a lower luminance efficiency, typically the red 12 and/or blue 16 light emitting element.

To understand the present invention, it is important to define the term "luminance efficiency". This term refers to the efficiency of an OLED emitter to produce luminance when driven to a known current. This entity is commonly measured in units of candelas per amp.

Figure 2:
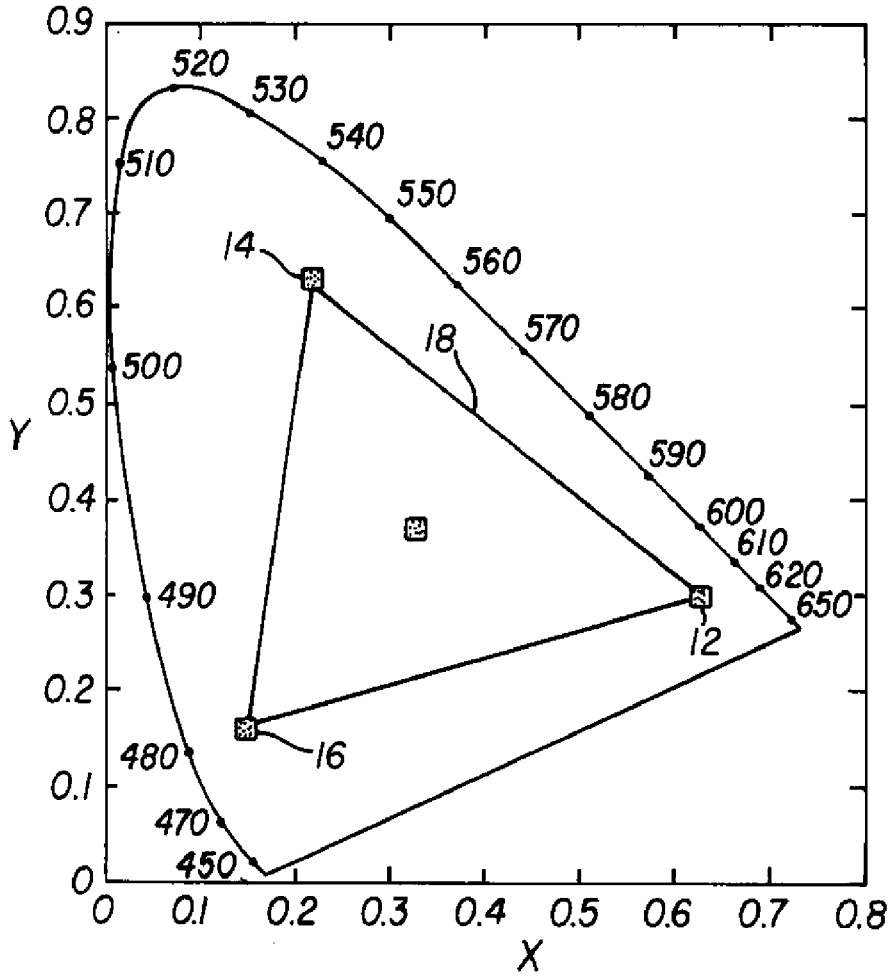
FIG. 2 is a CIE chromaticity diagram showing coordinates for red, green, and blue OLEDs.

Looking again at FIG. 2, one may select the additional primary such that its CIE chromaticity coordinate is plotted to the left of a line adjoining the CIE chromaticity coordinate of the blue light emitting element 16 and the chromaticity coordinate of the green light emitting element 14. In an OLED display device this light emitting element will be referred to as a cyan OLED. However, it will be recognized that the most common color name that may be assigned to any particular OLED within this space may not necessarily be cyan. Alternatively, the CIE chromaticity coordinate of the additional primary may be such that it is plotted to the right of a line adjoining the CIE chromaticity coordinate of the green light emitting 14 and the CIE chromaticity coordinate of the red light emitting element 12. In an OLED display such a light emitting element will be referred to as a yellow OLED. Again it will be recognized that the most common color name that may be assigned to any particular OLED within this space may not necessarily be yellow.

Figure 3:
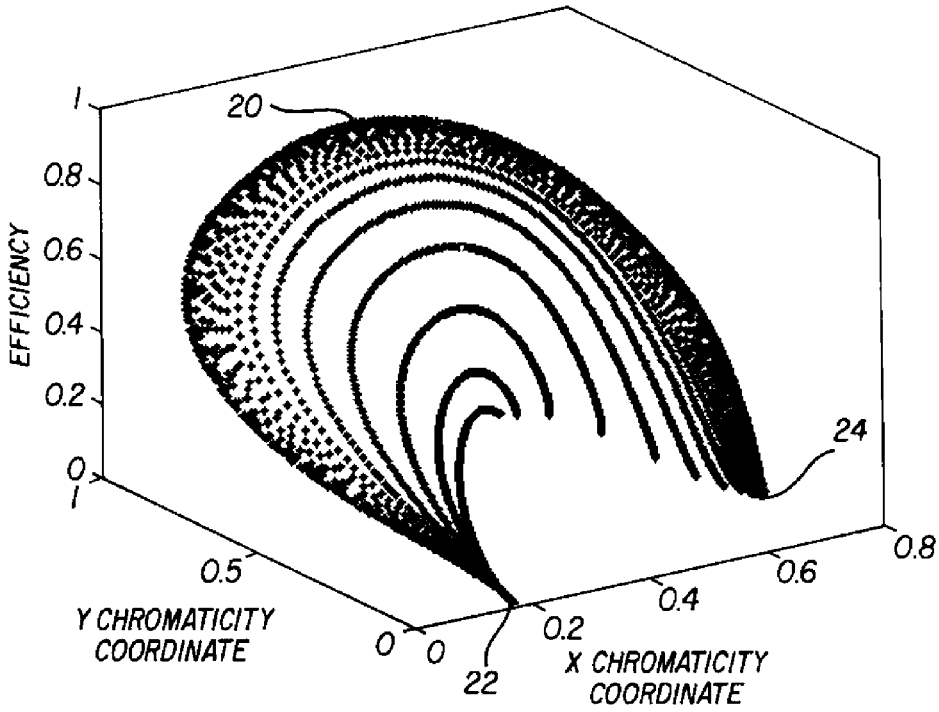
FIG. 3 is a graph showing photopic efficiency as a function of chromaticity coordinates.

In any display device, it is reasonable that cyan light emitting elements may be created that are higher in efficiency than blue light emitting elements. It is also reasonable that yellow light emitting elements may be created that are higher in efficiency than red light emitting elements. Each of these statements are supported by the fact that the human eye is more sensitive to electromagnetic energy with peak wavelengths in the cyan and yellow regions of the spectra as compared to spectra with peak wavelengths in the blue or red portions of the visible spectrum. The relationship between efficiency of the human eye (photopic efficiency) and the color of the emitter can be illustrated by plotting photopic efficiency as a function of chromaticity coordinate for representative, single peak, spectra as shown in FIG. 3. As this figure shows, photopic efficiency is highest (point 20) for a single peak spectra that has a chromaticity coordinate of (0.12, 0.85), and declines following a monotonic function as the y coordinate on the CIE chromaticity coordinate decreases. Therefore, the photopic efficiency of a blue spectra (e.g., point 22) and the photopic efficiency of a red spectra (e.g., point 24) are very close to zero.

It will further be recognized that it is not absolutely necessary that the spectral content of the green light emitting element be such that it produces a color that would typically be named green. However, this light emitting element will have a CIE y chromaticity coordinate that is larger than the CIE y chromaticity coordinate of the blue light emitting element 16 and CIE y chromaticity coordinate of the red light emitting element 12.

Figure 4:
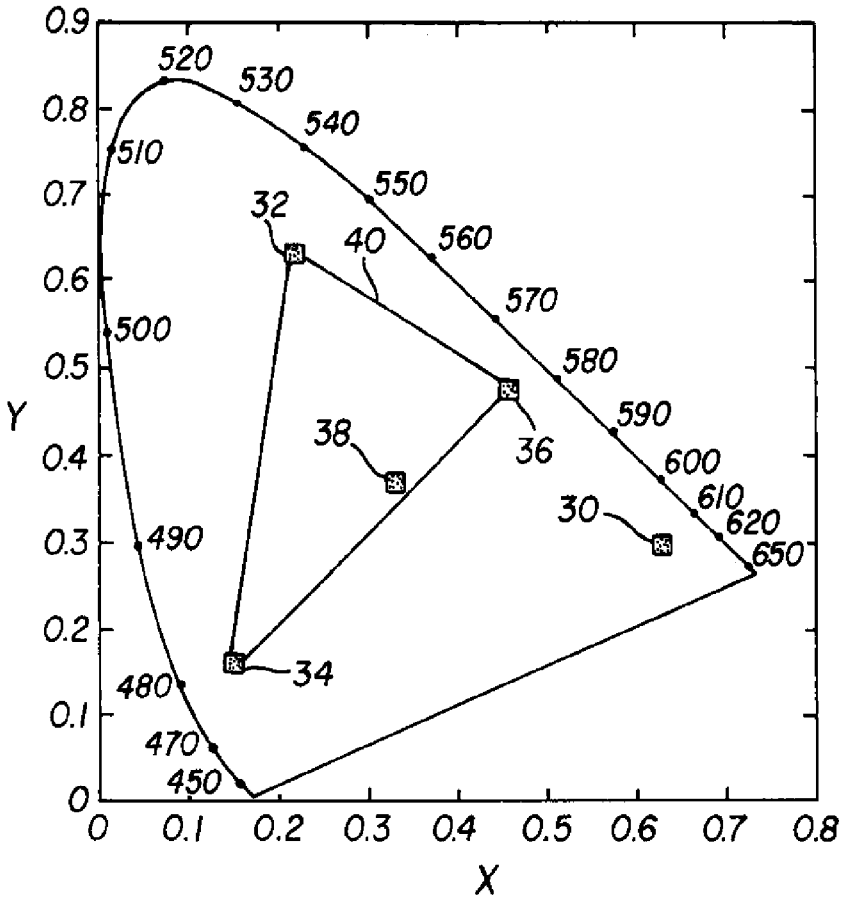
FIG. 4 is a CIE chromaticity diagram showing coordinates for red, green, blue and yellow OLEDs.

FIG. 4 shows the CIE chromaticity coordinates of OLEDs in a display device in accordance with one embodiment of the present invention. This display device includes red 30, green 32, and blue 34 OLEDs as are present within prior-art display devices. This display device additionally includes an additional yellow 36 OLED. FIG. 4 also shows the white point of the display 38. A triangle 40 is shown connecting the chromaticity coordinates of the red 30, green 32, and yellow 36 OLEDs that enclose the white point of the display device. Since this triangle encloses the white point of the display, the most frequently occurring colors (e.g., white and near white colors) can be created from the combination of the high luminance efficiency green OLED, a high luminance efficiency yellow OLED, and the blue light emitting OLED element. To reduce the power consumption of the display device a three to four color conversion must be provided that takes maximum advantage of the most efficient light emitting elements. This function is provided by a signal processor that converts a standard color image signal to a power saving image signal that is employed to drive the display of the present invention, without compromising color accuracy.

The present invention can be employed in most OLED device configurations that allow four or more OLEDs per pixel. These include very unsophisticated structures comprising a separate anode and cathode per OLED to more sophisticated devices, such as passive-matrix displays having orthogonal arrays of anodes and cathodes to form pixels, and active-matrix displays where each pixel is controlled independently, for example, with a thin-film transistor (TFT).

Figure 5:
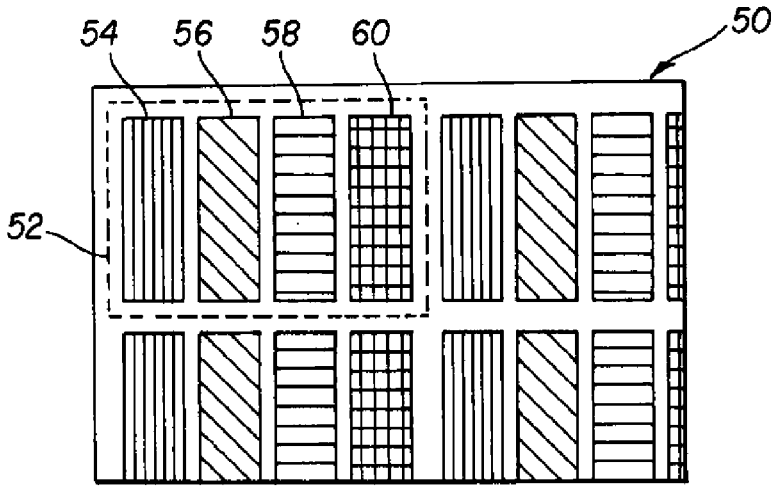
FIG. 5 is a schematic diagram illustrating a pattern of OLEDs according to one embodiment of the present invention.

The present invention may comprise an arrangement of OLED light emitting elements as shown in FIG. 5. As shown in this figure, the display device 50 includes an array of pixels 52, each pixel consisting of red 54, green 56, blue 58 and yellow 60 OLEDs.

Figure 6:
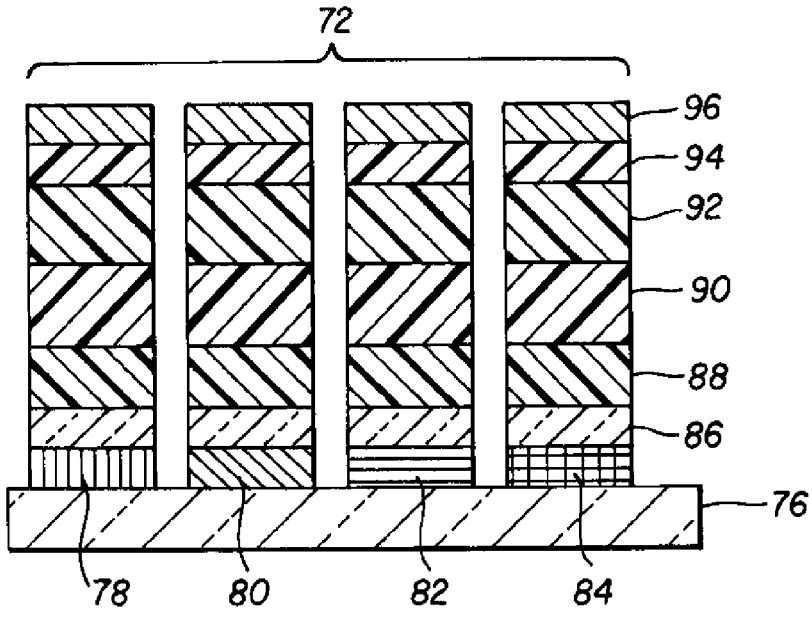
FIG. 6 is a schematic diagram illustrating a cross section of a series of OLEDs according to one embodiment of the present invention.

A schematic diagram of a cross section of one embodiment of such a display is shown in FIG. 6. There are numerous configurations of the organic layers wherein the present invention can be successfully practiced. A typical structure is shown in FIG. 6, each pixel 72 of the display device has four OLEDs. Each OLED is formed on a transparent substrate 76. On this substrate are formed, red 78, green 80, blue 82, and yellow 84 color filters. A transparent anode 86 is then formed over the color filter followed by the layers typically used to construct an OLED display. Here the OLED materials include a hole injecting layer 88, a hole transporting layer 90, a light emitting layer 92 and an electron transporting layer 94. Finally a cathode 96 is formed.

These layers are described in detail below. Note that the substrate may alternatively be located adjacent to the cathode, or the substrate may actually constitute the anode or cathode. The organic layers between the anode and cathode are conveniently referred to as the organic light emitting layer. The total combined thickness of the organic light emitting layer is preferably less than 500 nm. The device may be a top-emitting device wherein light is emitted through a cover or a bottom-emitting device that emits light through a substrate (as shown in FIG. 6).

A bottom-emitting OLED device according to the present invention is typically provided over a supporting substrate 76 on which is patterned the color filters. Either the cathode or anode can be in contact with the color filters and the substrate. The electrode in contact with the substrate is conventionally referred to as the bottom electrode. Conventionally, the bottom electrode is the anode, but this invention is not limited to that configuration. The substrate can either be light transmissive or opaque, depending on the intended direction of light emission. The light transmissive property is desirable for viewing the EL emission through the substrate. Transparent glass or plastic is commonly employed in such cases. For applications where the EL emission is viewed through the top electrode, the transmissive characteristic of the bottom support is immaterial, and therefore can be light transmissive, light absorbing or light reflective. Substrates for use in this case include, but are not limited to, glass, plastic, semiconductor materials, silicon, ceramics, and circuit board materials. Of course it is necessary to provide in these device configurations a light-transparent top electrode.

When EL emission is viewed through the anode 86, the anode should be transparent or substantially transparent to the emission of interest. Common transparent anode materials used in this invention are indium-tin oxide (ITO), indium-zinc oxide (IZO) and tin oxide, but other metal oxides can work including, but not limited to, aluminum- or indium-doped zinc oxide, magnesium-indium oxide, and nickel-tungsten oxide. In addition to these oxides, metal nitrides, such as gallium nitride, and metal selenides, such as zinc selenide, and metal sulfides, such as zinc sulfide, can be used as the anode. For applications where EL emission is viewed only through the cathode electrode, the transmissive characteristics of anode are immaterial and any conductive material can be used, transparent, opaque or reflective. Example conductors for this application include, but are not limited to, gold, iridium, molybdenum, palladium, and platinum. Typical anode materials, transmissive or otherwise, have a work function of 4.1 eV or greater. Desired anode materials are commonly deposited by any suitable means such as evaporation, sputtering, chemical vapor deposition, or electrochemical means. Anodes can be patterned using well-known photolithographic processes.

It is often useful to provide a hole-injecting layer 88 between the anode 86 and hole-transporting layer 90. The hole-injecting material can serve to improve the film formation property of subsequent organic layers and to facilitate injection of holes into the hole-transporting layer. Suitable materials for use in the hole-injecting layer include, but are not limited to, porphyrinic compounds as described in U.S. Pat. No. 4,720,432, and plasma-deposited fluorocarbon polymers as described in U.S. Pat. No. 6,208,075. Alternative hole-injecting materials reportedly useful in organic EL devices are described in EP 0 891 121 A1 and EP 1 029 909 A1.

The hole-transporting layer 90 contains at least one hole-transporting compound such as an aromatic tertiary amine, where the latter is understood to be a compound containing at least one trivalent nitrogen atom that is bonded only to carbon atoms, at least one of which is a member of an aromatic ring. In one form the aromatic tertiary amine can be an arylamine, such as a monoarylamine, diarylamine, triarylamine, or a polymeric arylamine. Exemplary monomeric triarylamines are illustrated by Klupfel et al. in U.S. Pat. No. 3,180,730. Other suitable triarylamines substituted with one or more vinyl radicals and/or comprising at least one active hydrogen containing group are disclosed by Brantley et al. in U.S. Pat. Nos. 3,567,450 and 3,658,520.

A more preferred class of aromatic tertiary amines are those which include at least two aromatic tertiary amine moieties as described in U.S. Pat. Nos. 4,720,432 and 5,061,569. The hole-transporting layer can be formed of a single or a mixture of aromatic tertiary amine compounds. Illustrative of useful aromatic tertiary amines are the following:

1,1-Bis(4-di-p-tolylaminophenyl)cyclohexane
1,1-Bis(4-di-p-tolylaminophenyl)-4-phenylcyclohexane
4,4'-Bis(diphenylamino)quadriphenyl
Bis(4-dimethylamino-2-methylphenyl)-phenylmethane
N,N,N-Tri(p-tolyl)amine
4-(di-p-tolylamino)-4'-[4(di-p-tolylamino)-styryl]stilbene
N,N,N',N'-Tetra-p-tolyl-4-4'-diaminobiphenyl
N,N,N',N'-Tetraphenyl-4,4'-diaminobiphenyl
N,N,N',N'-tetra-1-naphthyl-4,4'-diaminobiphenyl
N,N,N',N'-tetra-2-naphthyl-4,4'-diaminobiphenyl
N-Phenylcarbazole
4,4'-Bis[N-(1-naphthyl)-N-phenylamino]biphenyl
4,4'-Bis[N-(1-naphthyl)-N-(2-naphthyl)amino]biphenyl
4,4"-Bis[N-(1-naphthyl)-N-phenylamino]p-terphenyl
4,4'-Bis[N-(2-naphthyl)-N-phenylamino]biphenyl
4,4'-Bis[N-(3-acenaphthenyl)-N-phenylamino]biphenyl
1,5-Bis[N-(1-naphthyl)-N-phenylamino]naphthalene
4,4'-Bis[N-(9-anthryl)-N-phenylamino]biphenyl
4,4"-Bis[N-(1-anthryl)-N-phenylamino]-p-terphenyl
4,4'-Bis[N-(2-phenanthryl)-N-phenylamino]biphenyl
4,4'-Bis[N-(8-fluoranthenyl)-N-phenylamino]biphenyl
4,4'-Bis[N-(2-pyrenyl)-N-phenylamino]biphenyl
4,4'-Bis[N-(2-naphthacenyl)-N-phenylamino]biphenyl
4,4'-Bis[N-(2-perylenyl)-N-phenylamino]biphenyl
4,4'-Bis[N-(1-coronenyl)-N-phenylamino]biphenyl
2,6-Bis(di-p-tolylamino)naphthalene
2,6-Bis[di-(1-naphthyl)amino]naphthalene
2,6-Bis[N-(1-naphthyl)-N-(2-naphthyl)amino]naphthalene
N,N,N',N'-Tetra(2-naphthyl)-4,4"-diamino-p-terphenyl
4,4'-Bis {N-phenyl-N-[4-(1-naphthyl)-phenyl]amino}biphenyl
4,4'-Bis[N-phenyl-N-(2-pyrenyl)amino]biphenyl 2,6-Bis[N,N-di(2-naphthyl)amine]fluorene 1,5-Bis[N-(1-naphthyl)-N-phenylamino]naphthalene Another class of useful hole-transporting materials includes polycyclic aromatic compounds as described in EP 1 009 041. In addition, polymeric hole-transporting materials can be used such as poly(N-vinylcarbazole) (PVK), polythiophenes, polypyrrole, polyaniline, and copolymers such as poly(3,4-ethylenedioxythiophene)/poly(4-styrenesulfonate) also called PEDOT/PSS.

As more fully described in U.S. Pat. Nos. 4,769,292 and 5,935,721, the light-emitting layer (LEL) 92 of the organic light emitting layer includes a luminescent or fluorescent material where electroluminescence is produced as a result of electron-hole pair recombination in this region. The light-emitting layer can be comprised of a single material, but more commonly consists of a host material doped with a guest compound or compounds where light emission comes primarily from the dopant and can be of any color. The host materials in the light-emitting layer can be an electron-transporting material, as defined below, a hole-transporting material, as defined above, or another material or combination of materials that support hole-electron recombination. The dopant is usually chosen from highly fluorescent dyes, but phosphorescent compounds, e.g., transition metal complexes as described in WO 98/55561, WO 00/18851, WO 00/57676, and WO 00/70655 are also useful. Dopants are typically coated as 0.01 to 10% by weight into the host material. Polymeric materials such as polyfluorenes and polyvinylarylenes (e.g., poly(p-phenylenevinylene), PPV) can also be used as the host material. In this case, small molecule dopants can be molecularly dispersed into the polymeric host, or the dopant could be added by copolymerizing a minor constituent into the host polymer.

An important relationship for choosing a dye as a dopant is a comparison of the bandgap potential which is defined as the energy difference between the highest occupied molecular orbital and the lowest unoccupied molecular orbital of the molecule. For efficient energy transfer from the host to the dopant molecule, a necessary condition is that the band gap of the dopant is smaller than that of the host material.

Host and emitting molecules known to be of use include, but are not limited to, those disclosed in U.S. Pat. Nos. 4,769,292; 5,141,671; 5,150,006; 5,151,629; 5,405,709; 5,484,922; 5,593,788; 5,645,948; 5,683,823; 5,755,999; 5,928,802; 5,935,720; 5,935,721; and 6,020,078.

Metal complexes of 8-hydroxyquinoline (oxine) and similar derivatives constitute one class of useful host compounds capable of supporting electroluminescence. Illustrative of useful chelated oxinoid compounds are the following:

CO-1: Aluminum trisoxine [alias, tris(8-quinolinolato)aluminum(III)]

CO-2: Magnesium bisoxine [alias, bis(8-quinolinolato)magnesium(II)]

CO-3: Bis[benzo{f}-8-quinolinolato]zinc (II)

CO-4: Bis(2-methyl-8-quinolinolato)aluminum(III)-μ-oxo-bis(2-methyl-8-quinolinolato) aluminum(III)

CO-5: Indium trisoxine [alias, tris(8-quinolinolato)indium]

CO-6: Aluminum tris(5-methyloxine) [alias, tris(5-methyl-8-quinolinolato) aluminum(III)]

CO-7: Lithium oxine [alias, (8-quinolinolato)lithium(I)]

CO-8: Gallium oxine [alias, tris(8-quinolinolato)gallium (III)]

CO-9: Zirconium oxine [alias, tetra(8-quinolinolato)zirconium(IV)]

Other classes of useful host materials include, but are not limited to: derivatives of anthracene, such as 9,10-di-(2-naphthyl)anthracene and derivatives thereof, distyrylarylene derivatives as described in U.S. Pat. No. 5,121,029, and benzazole derivatives, for example, 2,2',2"-(1,3,5-phenylene)tris[1-phenyl-1H-benzimidazole].

Useful fluorescent dopants include, but are not limited to, derivatives of anthracene, tetracene, xanthene, perylene, rubrene, coumarin, rhodamine, quinacridone, dicyanomethylenepyran compounds, thiopyran compounds, polymethine compounds, pyrilium and thiapyrilium compounds, fluorene derivatives, periflanthene derivatives and carbostyryl compounds. Electron-Transporting Layer (ETL).

Preferred thin film-forming materials for use in forming the electron-transporting layer 94 of the organic light emitting layers of this invention are metal chelated oxinoid compounds, including chelates of oxine itself (also commonly referred to as 8-quinolinol or 8-hydroxyquinoline). Such compounds help to inject and transport electrons, exhibit high levels of performance, and are readily fabricated in the form of thin films. Exemplary oxinoid compounds were listed previously.

Other electron-transporting materials include various butadiene derivatives as disclosed in U.S. Pat. No. 4,356,429 and various heterocyclic optical brighteners as described in U.S. Pat. No. 4,539,507. Benzazoles and triazines are also useful electron-transporting materials.

In some instances, layers 92 and 94 can optionally be collapsed into a single layer that serves the function of supporting both light emission and electron transport. These layers can be collapsed in both small molecule OLED systems and in polymeric OLED systems. For example, in polymeric systems, it is common to employ a hole-transporting layer such as PEDOT-PSS with a polymeric light-emitting layer such as PPV. In this system, PPV serves the function of supporting both light emission and electron transport.

When light emission is viewed solely through the anode, the cathode 96 used in this invention can be comprised of nearly any conductive material. Desirable materials have good film-forming properties to ensure good contact with the underlying organic layer, promote electron injection at low voltage, and have good luminance stability over time. Useful cathode materials often contain a low work function metal (<4.0 eV) or metal alloy. One preferred cathode material is comprised of a Mg:Ag alloy wherein the percentage of silver is in the range of 1 to 20%, as described in U.S. Pat. No. 4,885,221. Another suitable class of cathode materials includes bilayers comprising a thin electron-injection layer (EIL) in contact with the organic layer (e.g., ETL), which is capped with a thicker layer of a conductive metal. Here, the EIL preferably includes a low work function metal or metal salt, and if so, the thicker capping layer does not need to have a low work function. One such cathode is comprised of a thin layer of LiF followed by a thicker layer of Al as described in U.S. Pat. No. 5,677,572. Other useful cathode material sets include, but are not limited to, those disclosed in U.S. Pat. Nos. 5,059,861; 5,059,862, and 6,140,763.

When light emission is viewed through the cathode, the cathode must be transparent or nearly transparent. For such applications, metals must be thin or one must use transparent conductive oxides, or a combination of these materials. Optically transparent cathodes have been described in more detail in U.S. Pats. No. 4,885,211, 5,247,190, JP 3,234,963, U.S. Pat. Nos. 5,703,436, 5,608,287, 5,837,391, 5,677,572, 5,776,622, 5,776,623, 5,714,838, 5,969,474, 5,739,545, 5,981,306, 6,137,223, 6,140,763, 6,172,459, EP 1 076 368, and U.S. Pat. No. 6,278,236. Cathode materials are typically deposited by evaporation, sputtering, or chemical vapor deposition. When needed, patterning can be achieved through many well known methods including, but not limited to, through-mask deposition, integral shadow masking as described in U.S. Pat. No. 5,276,380 and EP 0 732 868, laser ablation, and selective chemical vapor deposition.

The organic materials mentioned above are suitably deposited through a vapor-phase method such as sublimation, but can be deposited from a fluid, for example, from a solvent with an optional binder to improve film formation. If the material is a polymer, solvent deposition is useful but other methods can be used, such as sputtering or thermal transfer from a donor sheet. The material to be deposited by sublimation can be vaporized from a sublimator "boat" often comprised of a tantalum material, e.g., as described in U.S. Pat. No. 6,237,529, or can be first coated onto a donor sheet and then sublimed in closer proximity to the substrate. Layers with a mixture of materials can utilize separate sublimator boats or the materials can be pre-mixed and coated from a single boat or donor sheet. Patterned deposition can be achieved using shadow masks, integral shadow masks (U.S. Pat. No. 5,294,870), spatially-defined thermal dye transfer from a donor sheet (U.S. Pat. Nos. 5,851,709 and 6,066,357) and inkjet method (U.S. Pat. No. 6,066,357).

Most OLED devices are sensitive to moisture or oxygen, or both, so they are commonly sealed in an inert atmosphere such as nitrogen or argon, along with a desiccant such as alumina, bauxite, calcium sulfate, clays, silica gel, zeolites, alkaline metal oxides, alkaline earth metal oxides, sulfates, or metal halides and perchlorates. Methods for encapsulation and desiccation include, but are not limited to, those described in U.S. Pat. No. 6,226,890. In addition, barrier layers such as SiOx, Teflon, and alternating inorganic/polymeric layers are known in the art for encapsulation.

OLED devices of this invention can employ various well-known optical effects in order to enhance its properties if desired. This includes optimizing layer thicknesses to yield maximum light transmission, providing dielectric mirror structures, replacing reflective electrodes with light-absorbing electrodes, providing anti-glare or anti-reflection coatings over the display, providing a polarizing medium over the display, or providing colored, neutral density, or color conversion filters over the display. Filters, polarizers, and anti-glare or anti-reflection coatings may be specifically provided over the cover or as part of the cover.

Although, it is possible to use color filters to modify the CIE coordinates of the OLEDs, optical effects, such as microcavities, may also be used to adjust the color of the light emission. These optical methods may be used to tune the wavelength of the light emission from the device and may be used to create the color of the OLEDs or they may be used in conjunction with color filters. Methods for constructing a display device employing microcavities have been described in copending, commonly assigned U.S. Ser. Nos. 10/346,424 and 10/368,513, the disclosures of which are incorporated by reference herein.

Figure 7:
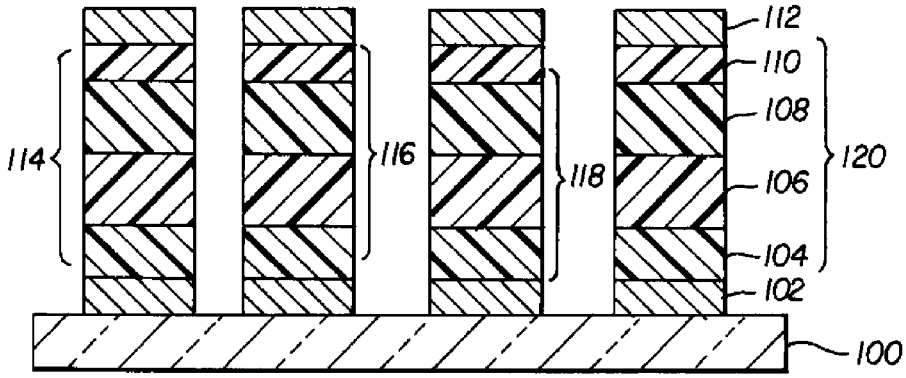
FIG. 7 is a schematic diagram illustrating a cross section of a series of OLEDs according to an alternative embodiment of the present invention.

A second particularly useful embodiment includes the use of several different OLED materials that are doped to provide different colors. For example, the red 54, green 56, blue 58 and yellow 60 OLEDs (FIG. 5) may be composed of different OLED materials that are doped to produce different colored OLEDs. This embodiment is illustrated in FIG. 7 which includes a plurality of OLEDs that are formed on a transparent substrate 100. On this substrate is formed an anode 102. On each anode is formed a stack of organic light emitting diode materials 104, 106, 108, and 110. Over the organic light emitting diode materials a cathode 112 is formed. Each of the organic light emitting diode material stacks (e.g., 114, 116, 118 and 120) are formed from a hole injecting layer 104, a hole transporting layer 106, a light emitting layer 108, and an electron transporting layer 110.

In this embodiment, the light emitting layer and potentially other layers within the stack of organic light emitting diode materials are selected to provide a red, green, blue, and yellow light emitting OLEDs. One stack of light emitting diode materials 114 emits energy primarily in the long wavelength or red portion of the visible spectrum. A second stack of light emitting diode materials 116 emits energy primarily in the middle wavelength or green portion of the visible spectrum. A third stack of light emitting diode materials 118 emits energy primarily in the short wavelength or blue portion of the visible spectrum. Finally, the fourth stack of light emitting diode materials 120 emits energy in a midrange of wavelengths that are longer than the green portion of the visible spectrum. In this way, the four different materials form a four color OLED device including red, green, blue, and yellow.

While the display device has been discussed as having red, green, blue and yellow primaries, it will be understood by one skilled in the art that in order to improve the efficiency of the display device, the yellow primary may be replaced by one or more other OLEDs outside the gamut defined by the red, green and blue OLEDs that is higher in luminous efficiency than one of the remaining OLEDs.

The display device will further comprise a signal processor associated to convert a standard three color input image signal to drive signals that drive the OLEDs in order to reduce the power consumption of the display device, extend the lifetime of the display device, or otherwise improve the performance of the display device. To provide a display with reduced power consumption, the conversion process must consider the efficiencies of the light emitting elements in the display to develop an appropriate conversion process. One method that considers the luminous efficiencies of the individual OLEDs follows.

As discussed earlier, the display device has a white point, generally adjustable by hardware or software via methods known in the art, but fixed for the purposes of this example. The white point is the color resulting from the combination of the three color primaries, in this example the red, green, and blue primaries, being driven to their highest addressable extent. The white point is defined by its chromaticity coordinates and its luminance, commonly referred to as xyY values, which may be converted to CIE XYZ tristimulus values by the following equations:

$$X = \frac{x}{y} \cdot Y$$

$$Y = Y$$

$$Z = \frac{(1 - x - y)}{y} \cdot Y$$

Noting that all three tristimulus values are scaled by luminance Y, it is apparent that the XYZ tristimulus values, in the strictest sense, have units of luminance, such as cd/m$^2$. However, white point luminance is often normalized to a dimensionless quantity with a value of 100, making it effectively percent luminance. Herein it will be assumed that the XYZ tristimulus values will be scaled such that Y represents percent luminance. Thus, a common display white point of D65 with xy chromaticity values of (0.3127, 0.3290) has XYZ tristimulus values of (95.0, 100.0, 108.9).

The display white point and the chromaticity coordinates of three display primaries, in this example the red, green, and blue primaries, together specify a phosphor matrix, the calculation of which is well known in the art. Also well known is that the colloquial term "phosphor matrix," though historically pertinent to CRT displays using light-emitting phosphors, may be used more generally in mathematical descriptions of displays with or without physical phosphor materials. The phosphor matrix converts intensities to XYZ tristimulus values, effectively modeling the additive color system that is the display, and in its inversion, converts XYZ tristimulus values to intensities.

The intensity of a primary is herein defined as a value proportional to the luminance of that primary and scaled such that the combination of unit intensity of each of the three primaries produces a color stimulus having XYZ tristimulus values equal to those of the display white point. This definition also constrains the scaling of the terms of the phosphor matrix. The OLED display example, with red, green, and blue primary chromaticity coordinates of (0.6782, 0.3215), (0.2437, 0.6183), and (0.1495, 0.0401), respectively, with the D65 white point, has a phosphor matrix M3:

$$M3 = \begin{bmatrix} 49.58 & 28.34 & 17.13 \\ 23.50 & 71.90 & 4.59 \\ 0.022 & 16.05 & 92.84 \end{bmatrix}$$

The phosphor matrix M3 times intensities as a column vector produces XYZ tristimulus values, as in this equation:

$$M3 \times \begin{bmatrix} I_1 \\ I_2 \\ I_3 \end{bmatrix} = \begin{bmatrix} X \\ Y \\ Z \end{bmatrix}$$

where I1 is the intensity of the red primary, I2 is the intensity of the green primary, and I3 is the intensity of the blue primary.

It is to be noted that phosphor matrices are typically linear matrix transformations, but the concept of a phosphor matrix transform may be generalized to any transform or series of transforms that leads from intensities to XYZ tristimulus values, or vice-versa.

The phosphor matrix may also be generalized to handle more than three primaries. The current example contains an additional primary with xy chromaticity coordinates (0.5306, 0.4659)—yellow. At a luminance arbitrarily chosen to be 100, the additional primary has XYZ tristimulus values of (113.9, 100.0, 0.7512). These three values may be appended to phosphor matrix M3 without modification to create a fourth column, although for convenience, the XYZ tristimulus values are scaled to the maximum values possible within the gamut defined by the red, green, and blue primaries. The phosphor matrix M4 is as follows:

$$M4 = \begin{bmatrix} 49.58 & 28.34 & 17.13 & 90.58 \\ 23.50 & 71.90 & 4.59 & 79.54 \\ 0.022 & 16.05 & 92.84 & 0.598 \end{bmatrix}$$

An equation similar to that presented earlier will allow conversion of a four-value vector of intensities, corresponding to the red, green, blue, and additional primaries, to the XYZ tristimulus values their combination would have in the display device:

$$M4 \times \begin{bmatrix} I_1 \\ I_2 \\ I_3 \\ I_4 \end{bmatrix} = \begin{bmatrix} X \\ Y \\ Z \end{bmatrix}$$

In general, the value of a phosphor matrix lies in its inversion, which allows for the specification of a color in XYZ tristimulus values and results in the intensities required to produce that color on the display device. Of course, the color gamut describes the range of colors whose reproduction is possible, and out-of-gamut XYZ tristimulus specifications result in intensities outside the range [0,1]. Known gamut-mapping techniques may be applied to avoid this situation, but their use is tangential to the present invention and need not be discussed. The inversion is simple in the case of 3×3 phosphor matrix M3, but in the case of 3×4 phosphor matrix M4 it is not uniquely defined and therefore a single inverted 3×4 phosphor matrix cannot be utilized to provide a robust transformation. The method provided herein, provides a method for assigning intensity values for all four primary channels without requiring the inversion of the 3×4 phosphor matrix.

The method of the present invention begins with color signals for the red, green, and blue primaries, in this example, intensities. These are reached either from a XYZ tristimulus value specification by the above described inversion of phosphor matrix M3 or by known methods of converting RGB, YCC, or other three-channel color signals, linearly or nonlinearly encoded, to intensities corresponding to the gamut-defining primaries and the display white point.

Figure 8:
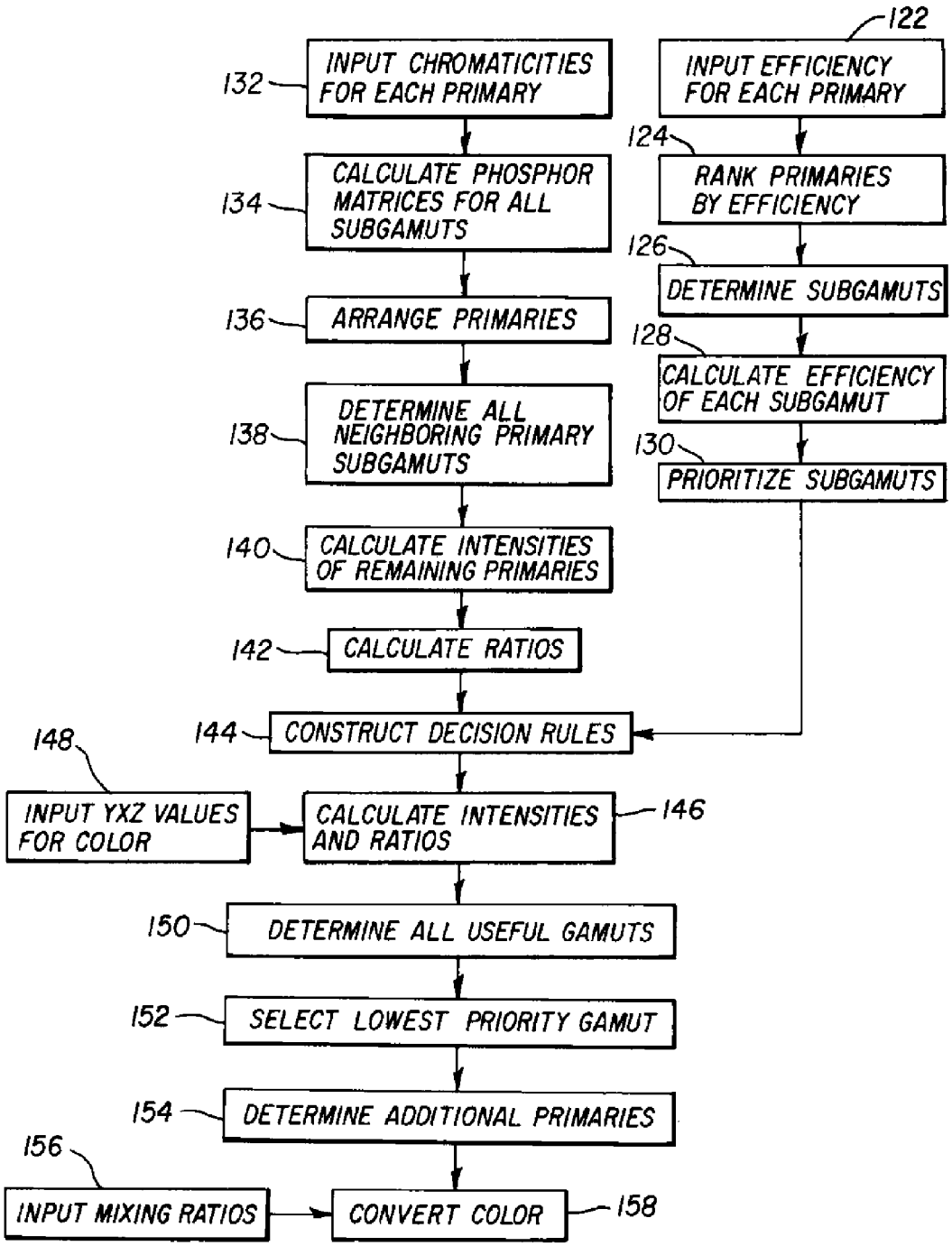
FIGS. 8 and 9 are segments of a flow chart illustrating an algorithm useful for programming a computer for mapping from conventional three color data to four OLEDs without any loss in saturation.

While a number of approaches may be used to simplify the problem of producing a converted color at near the minimum power, a desirable approach which may be used in accordance with one embodiment of the invention is shown in FIG. 8. As shown in this figure, the process begins with inputting 122 the efficiencies for each primary. The primaries are then ranked 124 from least to most efficient. A list of all possible combinations of three primaries (i.e., all possible subgamuts) are determined 126. In a display device for which the minimum power use is desired, the average efficiency or similar entity which correlates with power consumption is calculated 128. This average efficiency may be calculated, e.g., by averaging the efficiencies of the three primaries used to form each subgamut. These subgamuts are then prioritized 130 by ordering them from the highest average efficiency to the lowest average efficiency.

The chromaticity coordinates are also input 132 for each primary. The phosphor matrices are then calculated 134 for all subgamuts to be used in the color conversion. The primaries are then arranged 136 from the primary with the shortest wavelength energy to the primary with the longest wavelength energy. This may be done using the chromaticity coordinates arranged to follow the border of the chromaticity diagram from blue to red. All of the subgamuts that may be formed from neighboring and non-overlapping sets of three primaries are then determined 138. Each of these subgamuts will then be defined by three primaries with a center primary in the list and two neighboring primaries at the extremes or ends of the triangle used to form the subgamut. As an example, subgamut triangle 40 formed from blue, green and yellow OLEDs in FIG. 4 would have green OLED 32 as the center primary and the blue OLED 34 and yellow OLED 36 primaries as the neighboring end primaries. A second non-overlapping subgamut would be defined by red OLED 30 as the center primary and the blue OLED 34 and yellow OLED 36 primaries as the neighboring end primaries.

For each of the subgamuts determined in step 138, the theoretical intensities for forming each primary that is not in each subgamut are calculated 140 (e.g., for subgamut 40, the theoretical intensities are calculated for forming the red OLED 42 primary). While it is not physically possible to form these colors using these gamuts, this calculation is useful as the ratios of the intensities for the outside primaries in the gamut define a line that segments subgamuts within the color space. The ratio of the theoretical intensities of the two primaries that are at the ends of the current subgamut used to form each primary outside the current subgamut is then calculated 142. Finally a set of decision rules are constructed 144 from this information. The decision rules are formed knowing that any color which has positive intensities when formed from one of the subgamuts determined in step 138 will lie within that subgamut. Any color that has negative values will lie outside the subgamut. However, any color having a ratio that is larger than the ratio determined in step 142 will lie to the same side of a line as the end primary that is used in the numerator of the ratio calculation performed in step 142 where this line intercepts the center primary and the corresponding primary from outside of the subgamut.

Based upon this information, a set of logic may be formed that indicates all possible home subgamuts for any input color which may be defined from a set of n primaries by calculating n−2 sets of intensity values and n/2 comparisons as opposed to calculating the intensities for all n!/(3!*(n−3)! combinations of the n primaries. The decision rules constructed 144 will also consider the priority of the subgamuts to provide a look-up table indicating which subgamut will be applied as a result of the calculations that are performed for each color that is input to the system. Steps 122 through steps 144 are dependent upon the primaries, their efficiencies and their chromaticity coordinates and for this reason, must only be performed once. These steps may be performed at device startup but may also be performed and the resulting decision rules stored in memory, allowing each of the following steps to be performed without further delay.

To apply this method, the XYZ values are input 148 for each color. The intensities and ratios for each set of XYZ values are then calculated 146 for each of the non-overlapping and neighboring subgamuts determined in step 138. Based upon the decision rules formed in step 144, all subgamuts useful in creating the desired color are determined 150. The lowest priority subgamut (e.g., the subgamut with the lowest average efficiency) is then selected 152. All additional primaries that are not in the lowest priority subgamut are then determined 154. A family of mixing ratios or functions are input 156. Finally, the actual color conversion is performed 158 as depicted in FIG. 9.

Note that in a display device having more than 3 primaries, any color may be formed from 2 or more subgamuts. To improve image quality, increase lifetime, or achieve some other desired state, it may be desirable to mix light from two or more combinations of subgamuts, applying more than three primaries to form a given color. The proportion of a set of intensities for a more energy efficient subgamut used to form a color as opposed to the proportion of a set of intensities for a less efficient subgamut that may be used to form the same color will be referred to as the "mixing ratio". Note that when the mixing ratio is high, much of the intensity is moved from a less-efficient subgamut of three primaries (in a four-color system, these less-efficient primaries will typically be RGB) to a more-efficient second subgamut (typically containing the additional primary), and when this mixing ratio is low, less of the intensity is moved from the less-efficient subgamut to the more-efficient subgamut. In our example, given that white is most efficiently formed from green, blue and yellow and that having the red OLED turned completely off may result in some image quality loss, we may decide to form white from a combination of the intensities used to form white from green, blue and yellow and, in this example, a smaller proportion of the intensity used to form white from red, green, and blue. In doing so, the red element is not turned completely off in this example, leading to a display that will have a more uniform appearance in flat image areas. Therefore, even if one does not calculate a correlate to an important display parameter, it may still be desirable to calculate a color from more than one gamut and to mix the intensities of the primaries from these two color gamuts to make the desired color.

Figure 9:
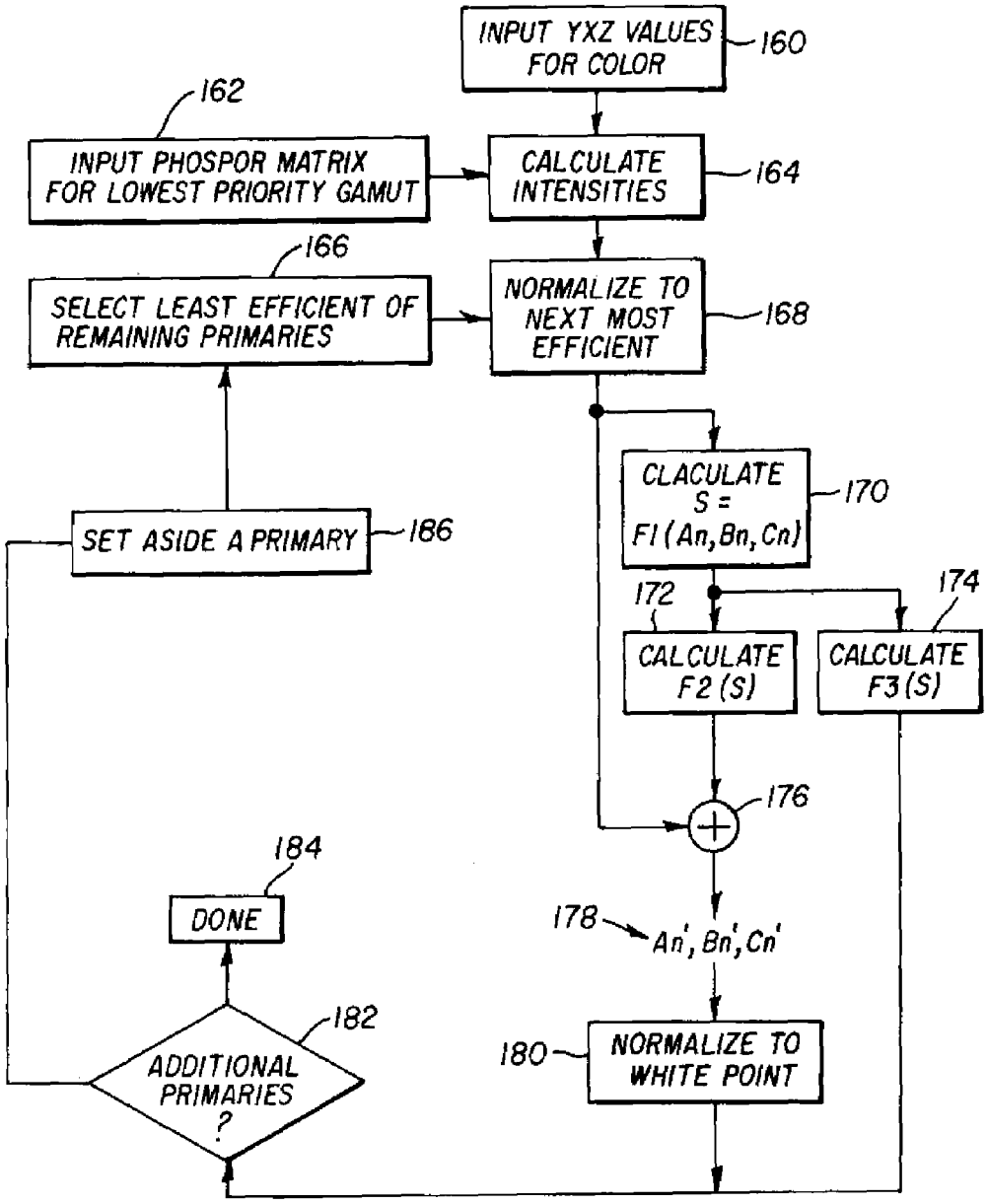

Once the process shown in FIG. 8 is completed, the process shown in FIG. 9 is conducted to perform the color conversion. As shown in FIG. 9, the three color input signals (XYZ) are input 160 into the system. These CIE XYZ tristimulus values may be calculated from other color metrics (RGB, YCC, etc.) using known methods. The input phosphor matrix for the lowest priority gamut capable of producing the desired color is selected 162 as discussed in step 152 of FIG. 8. The intensities that are required from the three primaries forming the lowest priority subgamut to produce the three-color input signal (XYZ) are then calculated 164 by multiplying the XYZ values by the phosphor matrix. Following the above red, green, yellow, blue OLED example and assuming the input color is the white point of the display, the two useful subgamuts will be defined by a combination of the red, green and blue primaries and a combination of the green, yellow and blue primaries. As the combination of red, green and blue primaries define the lowest priority subgamut, the intensities of the red, green, and blue primaries would thus be calculated for the color input signal (XYZ) in step 164.

The least efficient of the remaining primaries determined in step 154 of FIG. 8 is then selected 166. The intensity values calculated in step 164 are normalized 168 with respect to the CIE XYZ tristimulus values of the least efficient of the remaining primaries. Following the OLED example, the red, green and blue intensities are normalized such that the combination of unit intensity of each produces a color stimulus having CIE XYZ tristimulus values equal to those of the yellow primary. This is accomplished by scaling the intensities, shown as a column vector, by the inverse of the intensities required to reproduce the color of the yellow primary using the red, green and blue primaries (note that A, B, and C in the following matrix represent generic primaries used in the method, and that in our example, these values would represent intensities for red, green and blue):

$$\begin{bmatrix} 0.663 & 0 & 0 \\ 0 & 1.61 & 0 \\ 0 & 0 & -9.89 \end{bmatrix} \times \begin{bmatrix} A \\ B \\ C \end{bmatrix} = \begin{bmatrix} An \\ Bn \\ Cn \end{bmatrix}$$

The normalized signals are used to calculate 170 a common signal S that is a function F1(An, Bn, Cn). In the present example, the function F1 is a special minimum function that chooses the smallest non-negative signal of the three normalized values. The common signal S is used to calculate 172 the value of function F2(S). In this example, function F2 provides arithmetic inversion:

$$F2(S)=-S$$

The output of function F2 is added 176 to the normalized color signals, resulting in normalized output signals (An', Bn', Cn') 178 corresponding to the original primary channels. These signals are normalized 180 to the display white point by scaling by the intensities required to reproduce the color of the yellow primary using the gamut-defining primaries, resulting in the output signals (A', B', C') which correspond to the input color channels:

$$\begin{bmatrix} 1.51 & 0 & 0 \\ 0 & 0.620 & 0 \\ 0 & 0 & -0.101 \end{bmatrix} \times \begin{bmatrix} An' \\ Bn' \\ Cn' \end{bmatrix} = \begin{bmatrix} A' \\ B' \\ C' \end{bmatrix}$$

The common signal S is used to calculate 174 the value of function F3(S). In our simple four-color OLED example, we will assume that function F3 is simply the identity function. The output of function F3 is assigned to the output signal, which is the color signal for the first of the additional primaries.

It should be noted that the functions F2 and F3 may be defined in any number of ways. In one desirable fashion, the functions F2 and F3 may include a common multiplier where this multiplier is the mixing ratio that is input in step 156 of FIG. 8. Alternative definitions of these functions may include other linear or nonlinear relationships between the common signal S and the output of the function. In the case where these functions are defined by a relationship that is more complex than a single multiplier, the "mixing ratio" may be more broadly defined to include the parameter sets or descriptions of these relationships. It may also be noted that the functions F1, F2 and F3 may be defined differently based upon the iteration or primary being added during the color conversion process.

Once the results of the functions F2 and F3 are determined, a decision 182 is made to determine if all primaries have been included in the process. If yes, as would be the case in the red, green, blue, and yellow example used here, the process is completed 184. However, if not, one of the primaries is set aside 186. The primary to be set aside is typically the one with the lowest intensity value but this primary may be selected in a number of other ways. Additional primaries are then added, stepping through this process for each additional primary, starting with selecting 166 the next most efficient of the remaining primaries and normalizing 168 the intensities of the primaries that remain after step 186 to the chromaticity coordinates of the next most efficient primary.

At a summary level, the method that has been described in detail calculates the intensities required of the primaries which define the lowest priority subgamut that may be used to form any color. Following this calculation, successive, more efficient, primaries which may be used in combination with these primaries to form the desired color are added and the combinations of intensities within the subgamut defined by this more efficient primary and two other primaries within the CIE chromaticity space are calculated. It should be noted that a subgamut is defined as a combination of the intensities of three of the more than three OLEDs. As applied here, only a fraction of the colors that may be produced by the display device will lie within any single subgamut. Progressing from the lowest priority subgamut to subgamuts including more efficient primaries will typically insure that the intensity combinations that are formed will be more power efficient than any other combination. Instances where a more efficient combination could be used may still be possible (e.g., where two primaries which may be used are very close in efficiencies), but will only result in a minimal decrease in power consumption.

To truly insure that all colors are formed in the most efficient manner, one may alternatively calculate the intensity required of each primary to form any color using all possible combinations of subgamuts and then calculate a correlate to an important display parameter (e.g., power consumption, current, current density, etc.) required to form each color using each subgamut. That is, in our example, white may be formed from the combination of red, green, and blue or from the combination of blue, green, and yellow. Therefore, we might calculate the power consumption necessary to form white from either of these combinations and then select the combination to form white from either of these subgamuts. Under certain circumstances, it may be most efficient simply to calculate the intensities required to form this color from each and every subgamut and then to determine which subgamuts yield physically realizable (e.g., positive) luminance values for each OLED and then to select the subgamuts that provide the most desirable characteristics (e.g., maximum efficiency or maximum display lifetime) from which to form the colors.

It is also worth noting that when the efficiencies of the primaries differ significantly, the most efficient way of making any color may only require the computation of small subset of the subgamuts. For example, one system that has been investigated by the authors included cyan and yellow primaries that were much more efficient than the remaining primaries and in this particular case, the most efficient means of forming any color required the calculation of only the non-overlapping cyan/yellow/green; cyan/yellow/red; and yellow/red/blue subgamuts. When prior calculation can be used to eliminate subgamuts that never produce the most efficient means to produce a color, only the remaining subgamuts need to be calculated to insure the lowest possible power. Under these circumstances, a parallel processor may be used to produce intensity values for all three subgamuts and then selection of drive intensities only requires one to determine the set of intensity values with only positive (physically realizable) intensity values.

It is valuable to note that the mixing ratio referred to in the method shown in FIG. 8 and FIG. 9 may be a constant value, resulting in equal ratios of luminance between the OLEDs within the subgamuts. However, as alluded to earlier, the mixing ratio may alternatively be a function of the common signal S. By making the mixing ratio a function of the overall intensity or luminance of one or a combination of more than one intensity or luminance values, the ratio of the luminance of individual OLEDs in the display device will change as a function of luminance output while the chromaticity coordinates of the integrated color that is produced will be equivalent. By using a function, smaller mixing ratios may be used for low luminance signals where the visibility of luminance nonuniformities due to having one or more OLEDs turned off are less likely to be appreciated by a human observer. Larger mixing ratios may be used when the luminance or intensity signal is high to not only help improved the perceived uniformity of the display device but to also spread the energy across multiple OLEDs to prevent driving any single OLED to very high luminance outputs, which typically will result in increased degradation of the OLED materials. Use of a function such as this will result in unequal luminance ratios between the OLEDs within the subgamuts as a function of luminance output level. A nonlinear function may simply be introduced using a look-up table. Alternatively, a cost function could be applied that balances more than two important display attributes (e.g., image quality and power efficiency) and this cost function may be employed to select the proportion of each subgamut to apply.

When, as in the example above, function F1 chooses the minimum non-negative signal, the choice of functions F2 and F3 determine how accurate the color reproduction will be for in-gamut colors. If F2 and F3 are both linear functions, F2 having negative slope and F3 having positive slope, the effect is the subtraction of intensity from the primaries with the lowest efficiencies and the addition of intensity to the primary with the next most highest efficiency. Further, when linear functions F2 and F3 have slopes equal in magnitude but opposite in sign, the intensity subtracted from the three primaries with the lowest efficiency is completely accounted for by the intensity assigned to the primary with the highest efficiency, preserving accurate color reproduction and providing luminance identical to the three color system.

It should be noted that the method for converting from a three-color signal to a four or more color signal may be instantiated in an ASIC or other hardware device that allows the conversion to be computed in real time. It will be recognized by one skilled in the art that it may have alternative embodiments. For example, the algorithm may be programmed in software and used to provide a real-time conversion. Alternatively, the algorithm may be used to create a 3D look-up table (LUT) or a matrix approximation to a 3D look-up table and this LUT may be embedded in an ASIC, software or alterative device to allow the color conversion to be performed in real time.

In any of these situations, functions F2 and F3 may be designed to vary according to the color represented by the color input signals. For example, the functions may become steeper as the luminance increases or the color saturation decreases, or they may change with respect to the hue of the color input signal (R, G, B). There are many combinations of functions F2 and F3 that will provide color accuracy with different levels of utilization of the additional primary with respect to the RGB primaries. Choice of these functions in the design or use of a display device will depend on its intended use and specifications. In an embodiment where color accuracy is required, the functions F2 and F3 will typically be equal to one another. Under these conditions, the average color difference when expressed in terms of $\Delta E^*(La^*b^*)$ will be less than 3 units for all colors within the RGB color gamut when comparing the display device when only the red, green and blue OLEDs are used and the same display device when all OLEDs are employed.

Savings in cost or in processing time may be realized by using signals that are approximations of intensity in the calculations. It is well known that image signals are often encoded non-linearly, either to maximize the use of bit-depth or to account for the characteristic curve (e.g. gamma) of the display device for which they are intended. Intensity was previously defined as normalized to unity at the device white point, but it is clear, given linear functions in the method, that scaling intensity to code value 255 for an eight-bit digital-to-analog processor (e.g., peak voltage, peak current, or any other quantity linearly related to the luminance output of each primary) is possible and will not result in color errors.

Figure 10:
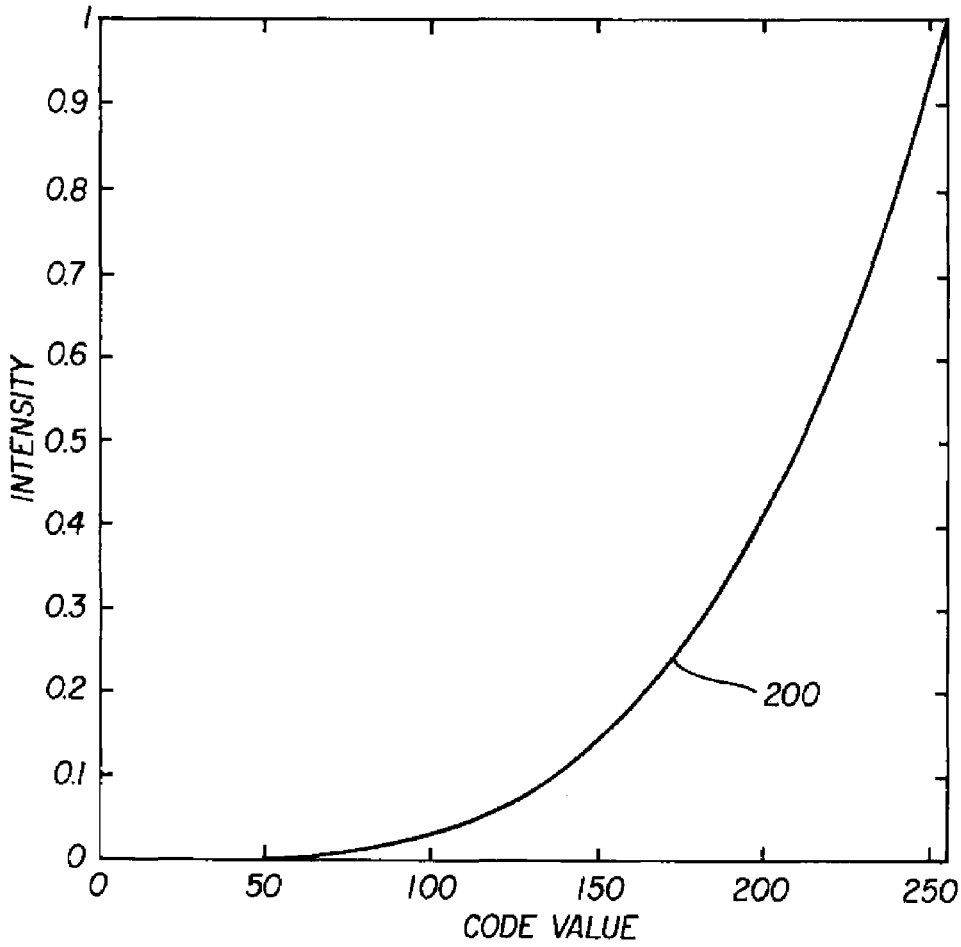
FIG. 10 is a graph showing the luminance output of a typical OLED as a function of a code value.

Approximating intensity by using a non-linearly related quantity, such as gamma-corrected code value, will result in color errors. However, depending on the deviation from linearity and which portion of the relationship is used, the errors might be acceptably small when considering the time or cost savings. For example, FIG. 10 shows the characteristic curve for an OLED, illustrating its non-linear intensity response to code value. The curve has a knee 200 above which it is much more linear in appearance than below. Using code value to approximate intensity for the total curve may lead to significant color reproduction errors, but subtracting a constant (approximately 175 for the example shown in FIG. 3) to use the knee 200 shown, from the code value makes a much better approximation for values above such constant. The signals (R,G,B) provided to the method shown in FIG. 8 are calculated as follows:

$$\begin{bmatrix} Rcv \\ Gcv \\ Bcv \end{bmatrix} - 175 = \begin{bmatrix} R \\ G \\ B \end{bmatrix}$$

The shift is removed after the method shown in FIG. 8 is completed by using the following step:

$$\begin{bmatrix} R' \\ G' \\ B' \end{bmatrix} + 175 = \begin{bmatrix} Rcv' \\ Gcv' \\ Bcv' \end{bmatrix}$$

This approximation may save processing time or hardware cost, because it replaces a look-up operation with simple addition.

It should be noted, that the color processing above does not consider the spatial layout of the OLEDs within the display device. However, it is known that traditional input signals assume that all of the OLEDs used to compose a pixel are located in the same spatial location. Visually apparent artifacts that are produced as a result of having the different colored OLEDs at different spatial locations are often compensated through the use of spatial interpolation algorithms, such as the one discussed by Klompenhouwer et al. (2002) "Subpixel Image Scaling for Color Matrix Displays" in SID 02 Digest, pp. 176-179. These algorithms will, depending upon the spatial content of the image, adjust the drive signal for each OLED to reduce the visibility of spatial artifacts and improve the image quality of the display, particularly near the edges of objects within the image and will be applied in conjunction with or after the before mentioned color processing is applied. It should be noted that the image quality improvement that is obtained near the edges of objects within the image is derived from increased sharpness of edges, decreases in the visibility of color fringing and improved edge smoothness.

Figure 1:
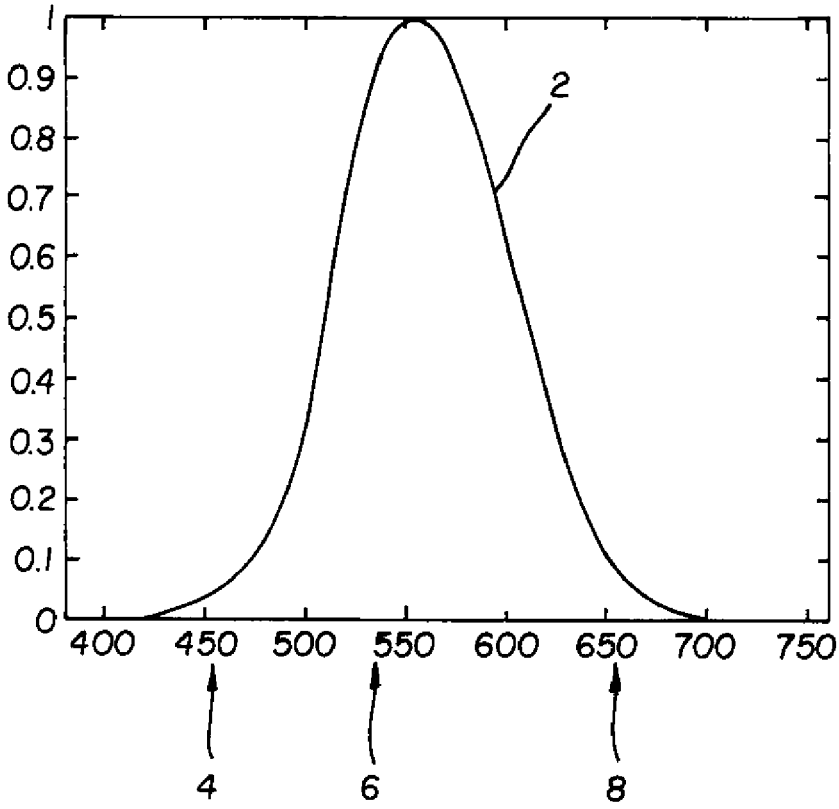
FIG. 1 is a graph showing the photopic luminosity function, which relates the human eye's sensitivity to electromagnetic energy as a function of wavelength.
Figure 11:
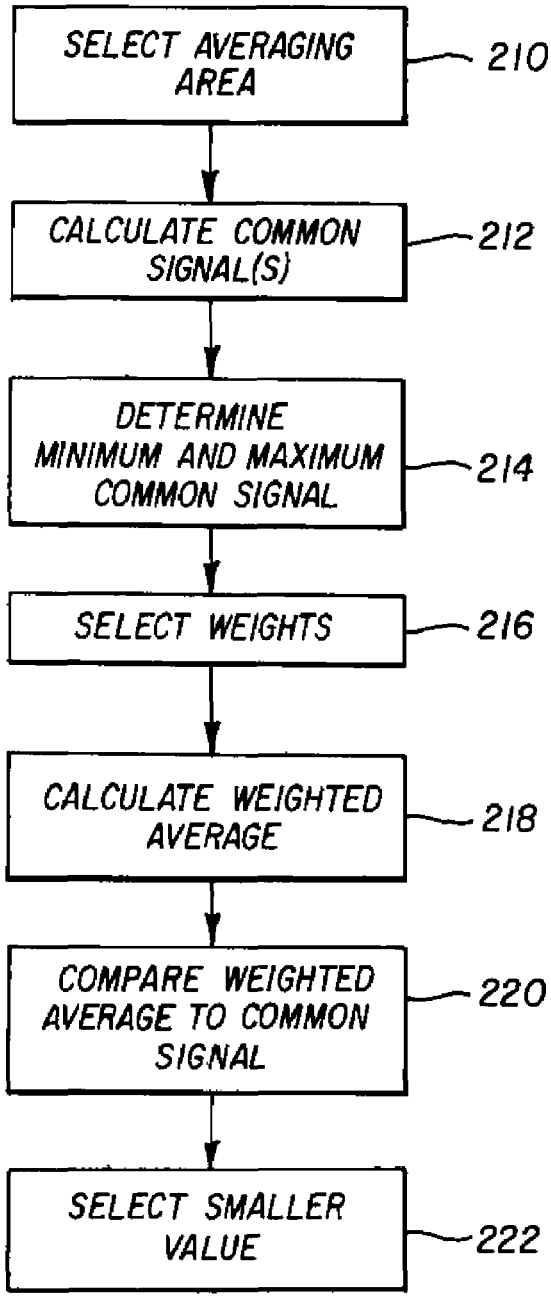
FIG. 11 is a flow chart illustrating an algorithm useful for programming a computer for altering the color mapping to reduce spatial artifacts near edges.

While this method provides an accurate method of converting from a three-color input signal to a four or more color signal, the color and luminance distribution along edges can be disrupted when the input signal has been sampled for display on a display with non-overlapping light emitting elements and methods such as those discussed by Klompenhouwer et al are not always sufficient for overcoming these artifacts. Instead it is necessary to smooth the transition of energy from one or more primaries to one or more other primaries as can occur near edges using the method described in FIGS. 8 and 9. This problem and some potential solutions for a four color system have been previously discussed by Primerano et al. copending, commonly assigned U.S. Ser. No. 10/703,748, the disclosure of which is incorporated by reference herein. A preferred method for performing this smoothing is shown in FIG. 1. As shown in FIG. 11, this method includes selecting an averaging area 210. That is, a group of pixels are selected over which to perform some smoothing of the mixing ratio. Next, steps 160 to 170 are performed in FIG. 9 to calculate 212 the common signal (S) as shown in FIG. 9 for each pixel within this selected group. The minimum and maximum common signal is then determined 214 within the selected averaging area. Weights for combining these minimum and maximum values are then selected 216 and used to calculate 218 a weighted average of the minimum and maximum values. This weighted average is then compared 220 to the original common signal (S) and the smallest value is selected 222. Once the new common signal has been selected 222, the remaining steps of the method shown in FIG. 9 are completed. It should be noted, that the steps of FIG. 11 are completed each time a common signal (S) is computed.

It should be recognized that the method shown in FIG. 11 will be of most value whenever the functions F2 and F3 shift a large proportion of the common signal from the normalized signal to the fourth signal. In fact, an alternative method of insuring higher image quality is to select functions F2 and F3 that shift one half or less of the common signal (S) from the original primaries to the additional primary. The functions F2 and F3 may be static functions but may also be altered in response to a control signal.

In the embodiment described here, it is assumed that the additional primaries that are added to the display system are more efficient than at least one of the red, green, and blue elements. This fact implies that this OLED will not be driven to as high a drive level as the red, green, and blue OLEDs to achieve the maximum luminance output. Since the lifetime of OLED materials are influenced significantly by the power at which they are driven, one might expect considerable improvement in the lifetime of this OLED display device over an OLED display device of the prior art. It is also true that the amount of utilization of each OLED will be different. For this reason, one may wish to apply differently sized OLEDs to optimize the lifetime of the display as described in US2004/0036421 A1 by Arnold et al.

In the implementation depicted in FIG. 7, OLEDs formed from materials that are doped to produce different colors may have significantly different luminance stabilities. That is, the change in luminance output that occurs over time is different for the different materials. To account for this, a material may be employed for the additional primary having a chromaticity coordinate that is positioned closer to the OLED with the shortest luminance stability over time than to the chromaticity coordinates of the other OLEDs. Positioning the additional OLED according to this criteria reduces the overall usage of the closest gamut-defining OLED, extending the lifetime of the closest gamut-defining OLED. Using this criteria and ordering the primaries and prioritizing the gamuts according to this criteria can allow this method to extend the overall lifetime of a display device having more than three primaries.

It is important to note that because the additional OLED is more efficient than at least one of the red, green, or blue OLEDs, the current density or power required to drive the additional OLED is lower than the current density required to drive the less luminance efficient OLEDs when producing the same color and luminance. It is also important to note that the luminance stability over time of the materials used to create the OLED is typically related to the current density used to drive the OLED through a very non-linear function in which the luminance stability over time of the material is much poorer when driven to higher current densities. In fact, the function used to describe this relationship can typically be described as a power function. For this reason, it is not desirable to drive any OLED to current densities that are higher than a given threshold where the function describing the luminance stability over time is particularly steep. At the same time, it may be desirable to achieve maximum display luminance values that would typically require the red, green, or blue OLEDs to be driven to this current density.

Since the current density required to drive the additional OLED is significantly lower than that required to drive at least one of the red, green, or blue OLEDs, it will be the last of the OLEDs to reach this threshold current density. Therefore, it may be desirable to map the conventional three-color data signal to the display such that the color reproduction (e.g., hue) of the image is compromised while producing the desired luminance without exceeding the threshold current density for any of the three OLEDs.

This may be accomplished in several ways. One way is to determine the red, green, or blue code values that will exceed this threshold, determine the difference in luminance for the display when the display is to be driven to the threshold response for any of the code values that exceed the threshold when compared to the luminance for the display when the display would be driven to the desired luminance and to add this difference in luminance to the luminance of the additional OLED. Through this means, the desired display luminance is achieved without surpassing the threshold current density for the red, green, or blue OLEDs. However, the luminance of the display is achieved by sacrificing the color accuracy of the displayed image and using the method described here, the color accuracy for the highly saturated, bright colors within the image may be reduced. Another way to perform this adjustment is to reduce the color accuracy for all image elements within the color channel that is likely to exceed the current density or power drive limit.

Although, we have discussed a method of effectively changing the functions F2 and F3 from FIG. 9 to alter the image quality, power efficiency, or lifetime of the display device, these functions may in fact be varied in response to any number of control signals in order to have many different desirable effects. The control signal will typically be dependent upon user settings, a state of the display system, the image content to be displayed, the power available to the display system, and/or a measurement of ambient illumination. When ambient illumination is sensed the display system may additionally adjust the luminance of the display to maintain display visibility under the appropriate ambient illumination conditions. By allowing the conversion to be dependent on user settings, the user is given the ability to trade image quality as affected by the mixing ratio for power efficiency. This conversion may additionally be dependent upon the luminance of the display. The display system may change the conversion to provide higher utilization of OLEDs with higher power efficiency and/or luminance stability over time for other luminance values. By doing this, conditions that may demand excessive power, or brightness, or may cause an unacceptable degradation of the display device may be avoided by adjusting mixing ratios.

Figure 12:
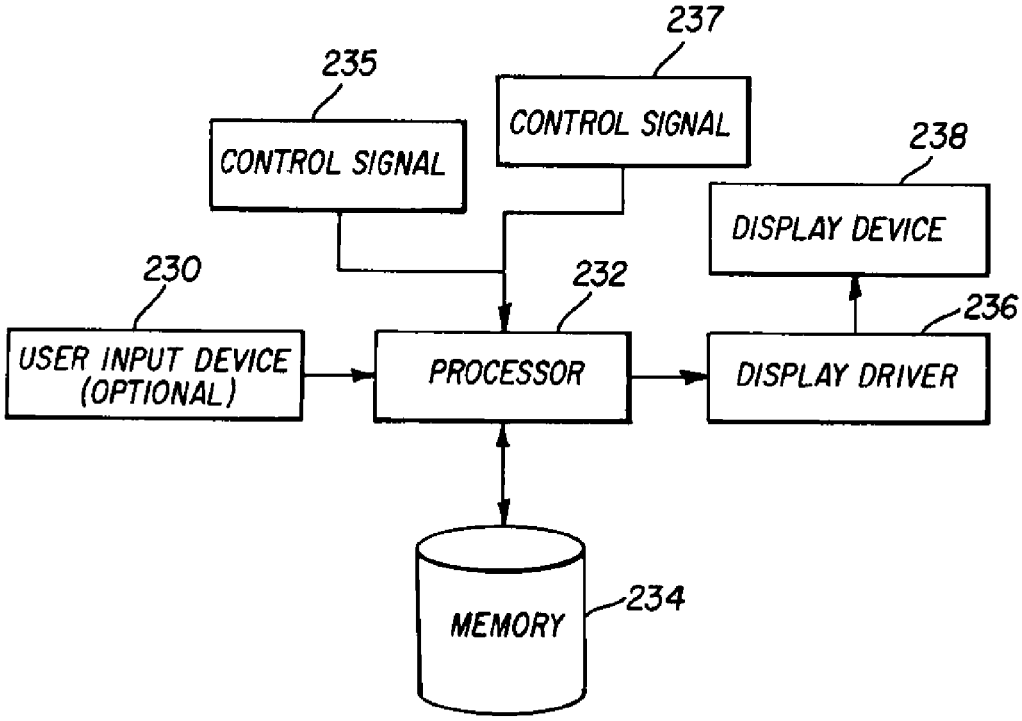
FIG. 12 is a schematic diagram illustrating a display system employing a display device of the present invention wherein the performance of the display device is altered based upon a control signal.

An embodiment of this invention, including a control signal is shown in FIG. 12. Referring to FIG. 12, the system includes an input device 230, processor 232, memory 234, display driver 236 and display device 238. The input device 230 may include any traditional input device including a joystick, trackball, mouse, rotating dial, switch, button or graphic user interface that may be used to select among two or more options from a series of user options. The processor 232 is any, or combination of any, digital or analog, general-purpose or custom controller(s) capable of performing the logic and calculation steps necessary to perform the steps of this invention. The processor 232 may be any computing device suitable to an application and may, or may not, be combined into a single component with the display driver 236. The memory 234 ideally includes non-volatile, writable memory that can be used to store user selections including EPROMS, EEPROMS, memory cards, or magnetic or optical discs.

The display driver 236 is one or more analog or digital signal processors or controllers capable of receiving a standard three-color image signal and converting this signal to a power-saving or lifetime-preserving drive signal compatible with the display device of the present invention. The display driver 236 will convert a 3-color signal to a 4-color signal. This display driver is additionally capable of receiving a control signal 235 from the processor 232 or a control signal 237 from an external source (not shown) and adjusting the conversion process in response to this control signal. Either or both control signals 235 or 237 may be employed. The processor 232 may supply the control signal 235 in response to, e.g., information regarding the age of the display, the charge of the power source, the content of the information to be displayed on the display 238, or the ambient illumination. Alternatively these signals may be supplied through an external control signal 237 from an ambient illumination sensor (for example a photosensor) or a device for measuring or recording the age of the display, or the charge of a power source.

The display device 238 is an OLED display device such as has been disclosed earlier having an array of pixels, each pixel having OLEDs for providing red, green, and blue colors and an additional OLED that lies beyond the gamut boundary formed by the red, green and blue OLEDs and is more efficient than at least one of the other gamut-defining OLEDs.

A variety of sources for the control signal may be employed. One such control signal may be produced by a signal representing the ambient illumination. In operation, the display driver 236 or processor 232 may respond to a signal representing the level of light in the ambient illumination. Under bright conditions, the color conversion process may be adjusted to convert a large proportion of the common signal (S) from the original three primaries to an additional primary to preserve power. Under dim conditions, mixing ratio may be selected to convert a smaller proportion of the common signal (S) from the original three primaries to an additional primary so that better image quality is provided under these viewing conditions. Preferably, the variation in the mixing ratio is accomplished gradually as the ambient light illumination increases so that any changes are imperceptible to a viewer. It is possible to limit the mixing ratio to some maximum (or minimum) value to optimize overall performance. It is also possible to provide a function, for example a linear or exponential function relating the mixing ratio and the ambient illumination to determine the mixing ratio desired at a particular ambient illumination level. Such functions may have limits, or damping constants, to limit the rate of change of the mixing ratio to reduce the perceptibility of any mixing ratio changes.

In an alternative embodiment, it is possible to use the state of the power supply to dictate the selection of the mixing ratio. In a situation where the power supply is depleted, aggressive power saving measures may be employed to reduce power usage. In this case, the mixing ratio may be maximized. When the power supply is fully charged, the mixing ratio may be reduced. As before, a gradual decrease in the mixing ratio may be employed to avoid perceptible changes over time.

In another alternative embodiment, it is possible to use the information shown on a display to dictate the mixing ratio. In a situation where a graphic interface having a textual component is employed on a display, the mixing ratio may be reduced. If images are shown on a display, the mixing ratio may be increased. However, it is also the case that graphic interfaces tend to use graphic elements for long times at specific locations, possibly causing the light-emissive materials at those display locations to degrade more rapidly than in other locations. The present invention may be employed to reduce both the current and the range of current densities in those locations. Therefore, the rate of degradation of the emissive materials and color differential degradation may be reduced.

In yet another alternative embodiment, it is possible to use the age of the display to dictate the mixing ratio. Typical OLED materials in use today degrade most rapidly when they are first used. After some period of time, the rate of degradation is reduced. In this situation, it may be helpful to reduce color differential aging at the beginning of the display lifetime by employing the present invention to reduce the maximum current density in the OLED elements and reduce the differences in current densities in the different OLED elements.

In is also possible to allow a display user to directly control the mixing ratio through a user interface. More likely, a power control mechanism may be employed by the user and the present invention may be employed along with other power saving measures such as reducing display brightness, to reduce power usage or improve display lifetime at the user's discretion. The user can then make tradeoffs between system attributes such as power usage, display visibility, and image quality.

Although a variety of embodiments employing the present invention are described herein, it is understood that other applications may require improved lifetime or reduced power usage for a display. Hence, the application of the present invention is not limited to the embodiments described herein.

Figure 13:
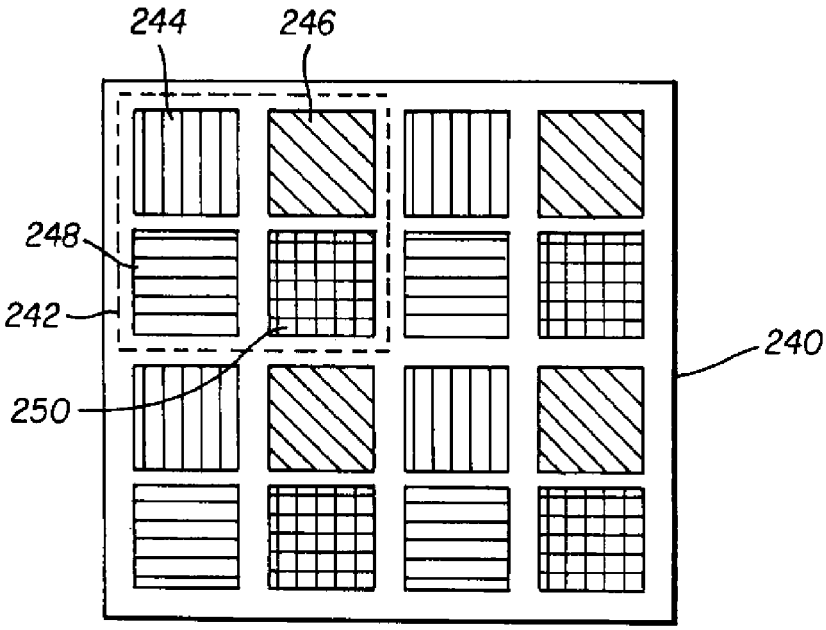
FIG. 13 is a schematic diagram illustrating a pattern of OLEDs arranged in one possible pixel pattern according to an alternative embodiment of the present invention.

Furthermore, in the embodiments that have been discussed, different pixel layouts, including different geometric shapes of OLEDs, may also be desirable. FIG. 13 shows another potential pixel layout. As shown in FIG. 13, the display device 240 is composed of an array of pixels 242. As in the earlier implementations, the pixel 242 is composed of a red 244, green 246, blue 248 and an additional (e.g., yellow) 250 OLED. However, within this implementation, the OLEDs are more spatially symmetric having nearly equal vertical and horizontal dimensions.

Figure 14:
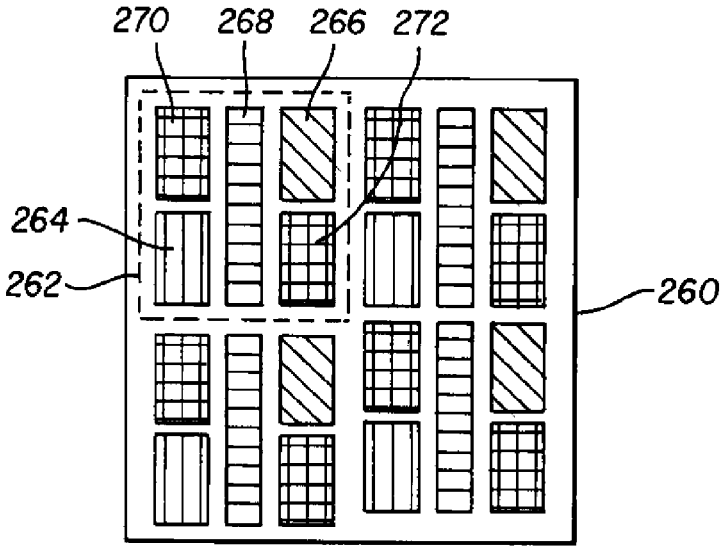
FIG. 14 is a schematic diagram illustrating a pattern of OLEDs arranged in one possible pixel pattern according to a further alternative embodiment of the present invention.

It can also be desirable to have differing resolutions of the different colored OLEDs in a pixel. It is well known that the spatial resolution of the human visual system is much higher for luminance than for chromaticity information. Since the additional (yellow) OLED will typically carry more luminance information than the other gamut-defining OLEDs, it will be desirable to have more additional OLEDs than any of the other gamut-defining OLEDs. A pixel arrangement having this characteristic is shown in FIG. 14. FIG. 14 shows a display device 260 composed of an array of pixels. Each pixel 262 is composed of a red 264, a green 266, and a blue 268 OLED. Additionally, the pixel includes two additional (e.g., yellow) OLEDs 270 and 272. As shown, the additional OLEDs are diagonally located at opposing corners of the pixel to maximize the spacing of these OLEDs. Further, the red and green OLEDs, which have the most luminance excluding the additional OLEDs, are further located diagonally across the opposing corners of the pixel. Within this embodiment, the additional OLED luminance that is calculated from the intensities is divided equally between the two additional OLEDs and the code value for each of the additional OLEDs is determined for one half of the calculated luminance value.

Figure 15:
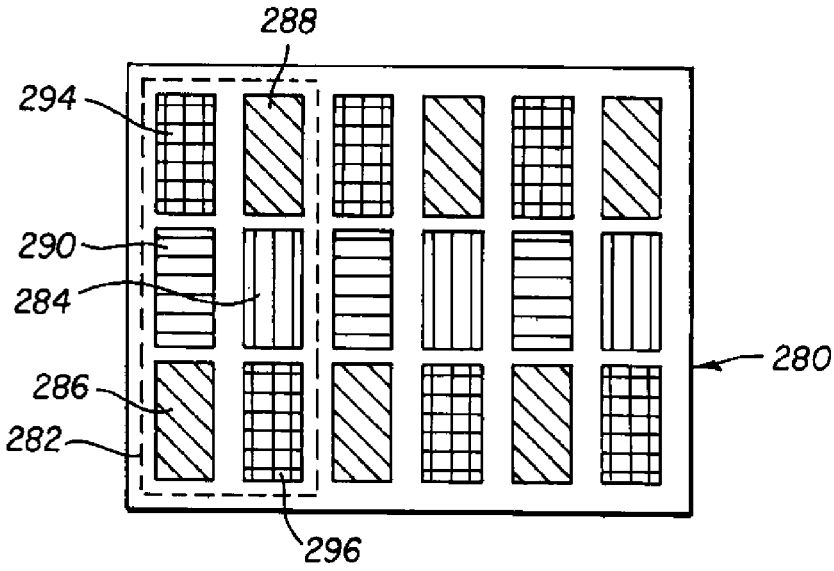
FIG. 15 is a schematic diagram illustrating a pattern of OLEDs arranged in one possible pixel pattern according to a further embodiment of the present invention.

It may be further recognized that one OLED will carry more luminance or require more power than other OLEDs, making it potentially desirable to have more of one the red, green and blue OLEDs than another within a pixel. FIG. 15 shows a display device 280 with an array of pixels. The pixel 282 is composed of one red OLED 284, two green OLEDs 286 and 288, one blue OLED 290 and two yellow OLEDs 294 and 296. It is desirable to maximize the separation of the yellow 294 and 296 and green OLEDs 286 and 288 within the pixel structure. As shown in FIG. 15, this is accomplished by placing each of the yellow OLEDs 294 and 296 at diagonally opposing corners of the pixel. The green OLEDs 286 and 288 are also positioned at diagonally opposing corners of the pixel 282. As described earlier, the luminance for the green OLEDs 286 and 288 and the yellow OLEDs 294 and 296 is calculated by dividing the luminance derived from the intensity values calculated for the green and yellow OLEDs by the number of OLEDs of the green and yellow OLEDs within the pixel 282.

It should be recognized that while one reason for using more OLEDs of one color than another is to improve the perceived sharpness of the OLED display device, it may also be desirable to use fewer OLEDs of one color than another (assuming that the OLEDs all have the same light emitting area) for a different reason. For example, to balance the lifetime of the different colored OLEDs, one may wish to utilize fewer additional OLEDs than red, green, or blue OLEDs simply because the materials that are known to be available to create a yellow OLED today have higher power efficiency and stability and therefore are likely to have a longer lifetime than the red, green, or blue OLEDs. Therefore, it may be desirable to produce a pixel on an OLED display device having fewer yellow OLEDs that are driven at higher current densities while providing more red, green, or blue OLEDs that are driven at lower current densities.

It should also be recognized that when a cyan or yellow OLED is used to replace the luminance that would typically have been produced by a blue or red OLED in a display device, the blue or red OLED will likely require a smaller area than the green OLED to have an equivalent lifetime. Since the human eye will also be less sensitive to spatial detail in colors that are composed of these blue or red OLEDs, it will also be desirable to produce a pixel on an OLED device having fewer red and blue OLEDs than green OLEDs.

Figure 16:
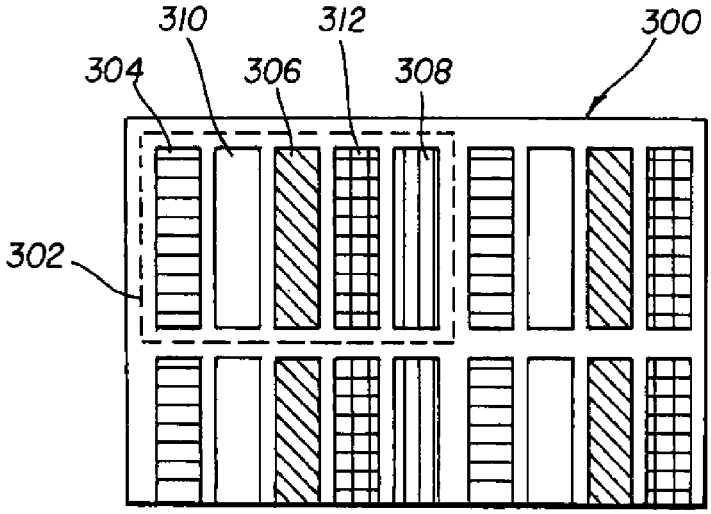
FIG. 16 is a schematic diagram illustrating a pattern of OLEDs arranged in one possible pixel pattern according to a further embodiment of the present invention.

While having four different colored OLEDs per pixel has been shown in many of the embodiments, pixel patterns may also be created with more than four colored OLEDs per pixel. FIG. 16 shows a pixel pattern on a display device 300 according the present invention having five different colors of OLEDs per pixel 302. Each pixel 302 in this display device may, for example, consist of a red 308, green 306, blue 304, yellow 312 and cyan 310 OLED. In such a device, white and many of the colors near white may be formed using a primarily the cyan 310 and yellow 312 OLEDs. If these two primaries are more efficient than two of the red 308, green 306, and blue 304 OLEDs, these more efficient primaries can be used to form the most frequently occurring colors and result in significantly decreased power consumption.

It may be noted from this pattern that since use of the cyan 310 OLED will typically replace the blue 304 OLED, to maintain luminance uniformity, it is important that the cyan 310 OLED be placed near the blue 304 OLED. Likewise use of the yellow 312 OLED will most commonly replace the red 308 OLED and therefore, to maintain luminance uniformity, it is important to locate the yellow 312 and red 308 OLEDs beside each other. To further improve uniformity, it may be desirable to locate at least one of the yellow 312 or cyan 310 OLEDs further from the green 306 than the blue 304 or red 308 OLED. This would necessitate the transposition of either or both of the yellow/red or cyan/blue pairs within the pattern shown in FIG. 16. Stacking of selected OLED primaries may also be employed to address display uniformity when employing more than three primaries, for example stacking blue and cyan primaries or red and yellow primaries. Additional patterns may be employed similarly as disclosed in copending, commonly assigned U.S. Ser. No. 10/459,293, the disclosure of which is incorporated by reference herein.

It should be noted that any of the different patterns of OLEDs that are used to define a pixel that the relative areas of the different OLEDs may be adjusted to preserve the lifetime to balance the lifetime of the different OLEDs within a pixel. It should also be noted that the interpolation algorithms that were discussed earlier to enhance the perceived resolution of the OLED display device may also be applied in any of these patterns.

The invention has been described in detail with particular reference to certain preferred embodiments thereof, but it will be understood that variations and modifications can be effected within the spirit and scope of the invention.

Parts List

2 photopic sensitivity curve
4 blue peak wavelength
6 green peak wavelength
8 red peak wavelength
12 chromaticity coordinate of a red OLED
14 chromaticity coordinate of a green OLED
16 chromaticity coordinate of a blue OLED
18 color gamut
20 highest efficiency point
22 blue spectra point
24 red spectra point
30 chromaticity coordinate of a red OLED
32 chromaticity coordinate of a green OLED
34 chromaticity coordinate of a blue OLED
36 chromaticity coordinate of a yellow OLED
40 triangle
50 display device
52 pixel
54 red OLED
56 green OLED
58 blue OLED
60 yellow OLED
72 pixel

76 substrate
78 red color filter
80 green color filter
82 blue color filter
84 yellow color filter
86 transparent anode
88 hole injecting layer
90 hole transporting layer
92 light emitting layer
94 electron transporting layer
96 cathode
100 transparent substrate
102 anode
104 hole injecting layer
106 hole transporting layer
108 light emitting layer
110 electron transporting layer
112 cathode
114 red OLED material stack
116 green OLED material stack
118 blue OLED material stack
120 yellow OLED material stack
122 input primaries efficiencies step
124 rank primaries step
126 determine sugamuts step
128 calculate average efficiencies step
130 prioritize subgamuts step
132 input chromaticity coordinates of primaries step
134 calculate phosphor matrices step
136 arrange primaries step
138 determine neighboring subgamuts step
140 calculate intensities of remaining primaries step
142 calculate ratios step
144 construct decision rules step
146 calculate intensities and ratios step
148 input XYZ values step
150 determine useful gamuts step
152 select lowest priority gamut step
154 determine additional primaries step
156 input mixing ratios step
158 color conversion step
160 input XYZ values step
162 input phosphor matrix for lowest priority gamut step
164 calculate intensities step
166 select least efficient of remaining primaries step
168 normalize intensities step
170 calculate signal S step
172 calculate F2(S) step
174 calculate F3(S) step
176 add step
178 nomalized output signal
180 normalize to white point step
182 decision step
184 complete step
186 set aside primary step
200 knee
210 select averaging area step
212 calculate common signal (S) step
214 determine minimum and maximum color signal step
216 select weights step
218 calculate a weighted average step
220 compare weighted average to common signal step
222 select smaller value step
230 input device
232 processor
234 memory
235 control signal
236 display driver
237 control signal
238 display device
240 display device
242 pixel
244 red OLED
246 green OLED
248 blue OLED
250 additional OLED
260 display device
262 pixel
264 red OLED
266 green OLED
268 blue OLED
270 additional OLED
272 additional OLED
280 display device
282 pixel
284 red OLED
286 green OLED
288 green OLED
290 blue OLED
294 yellow OLED
296 yellow OLED
300 display device
302 pixel
304 blue OLED
306 green OLED
308 red OLED
310 cyan OLED
312 yellow OLED

What is claimed is:

1. A color OLED display device, comprising:

a) an array of light emitting pixels, each pixel having red, green, and blue OLEDs and at least one additional colored OLED that expands the gamut of the display device relative to the gamut defined by the red, green and blue OLEDs, wherein the luminance efficiency or the luminance stability over time of the additional OLED is higher than the luminance efficiency or the luminance stability over time of at least one of the red, green, and blue OLEDs; and b) means for selectively driving the OLEDs with a drive signal to reduce overall power usage or extend the lifetime of the display while maintaining display color accuracy, wherein the means for driving further comprises means for trading off power usage for display lifetime.

2. The display device claimed in claim 1 wherein the means for driving the OLEDs results in a drive signal to produce a given color and luminance at a reduced power usage.

3. The display device claimed in claim 2, wherein the means for driving considers the luminance efficiency of each OLED to deliver the reduced power usage.

4. The display device claimed in claim 1, wherein the means for driving the OLEDs results in a drive signal to produce a given color and luminance at an improved lifetime.

5. The display device claimed in claim 4, wherein the means for driving considers the luminance efficiency of each OLED to deliver the improved lifetime.

6. The display device claimed in claim 4, wherein the means for driving considers the luminance stability over time of the material used to form each OLED to deliver improved lifetime.

7. The display device claimed in claim 1, wherein the drive signal is dependent upon a control signal.

8. The display device claimed in claim 7, wherein the control signal varies as a function one or more of a set including a resistance, voltage, current, temperature, ambient illumination, display luminance, and/or scene content.

9. The display device claimed in claim 1, wherein the means for driving produces a constant ratio of luminance values between two different color OLEDs while the integrated color produced by the combination of all the OLEDs has a constant chromaticity coordinate.

10. The display device claimed in claim 1, wherein the means for driving produces a variable ratio of luminance values between two different color OLEDs while the integrated color produced by the combination of all the OLEDs has a constant chromaticity coordinate.

11. The display device claimed in claim 1, wherein the means for driving the OLEDs provides a means for converting a three-color input signal to a four or more number of colors signal equal to the number of different color light emitting OLEDs in each pixel.

12. The OLED display device claimed in claim 1, wherein one or more of the additional OLEDs is cyan in color.

13. The OLED display device claimed in claim 1, wherein one or more of the additional OLEDs is yellow in color.

14. The OLED display device claimed in claim 1, wherein one or more of the OLEDs are formed by patterning different emissive materials that emit light of different colors to form the OLED.

15. The OLED display device claimed in claim 1, wherein one or more of the OLEDs are formed by patterning a white-light emissive material.

16. The OLED display device claimed in claim 15, wherein the color of one or more of the OLEDs is produced using a color filter.

17. The OLED display device claimed in claim 15, wherein the color of one or more of the OLEDs is produced using a microcavity structure.

18. The OLED display device claimed in claim 1, wherein the OLEDs are of different sizes.

19. The OLED display device claimed in claim 1, wherein the additional OLED is larger than at least one of the red, green, or blue OLEDs.

20. The OLED display device in claim 1, wherein the OLED display device is a top-emitting OLED device.

21. The OLED display device in claim 1, wherein the OLED display device is a bottom-emitting OLED device.

22. The OLED display device in claim 1, wherein the OLED display device is an active-matrix device.

23. The OLED display device in claim 1, wherein the OLED display device is a passive-matrix device.

24. The OLED display device claimed in claim 1, wherein the means for driving reduces power usage to a minimum by selecting the combination of three OLEDs in each pixel that results in the lowest power consumption for producing a desired color in each pixel.

25. The OLED display device claimed in claim 1, wherein the means for driving produces colors near white using a combination of light from the additional OLED(s) and light from one or fewer of the two OLEDs with the lowest luminance efficiency.

26. The OLED display device claimed in claim 25, wherein the two OLEDs with the lowest luminance efficiency are the red and blue OLEDs.

27. The OLED display device claimed in claim 1, having two or more additional OLEDs that expand the gamut relative to the gamut defined by the red, green and blue OLEDs, wherein one or more of the additional OLEDs emits cyan light and one or more of the additional OLEDs emits yellow light.

28. The OLED display device claimed in claim 27, wherein red and yellow OLEDs are positioned next to one another.

29. The OLED display device claimed in claim 27, wherein blue and cyan OLEDs are positioned next to one another.

30. The OLED display device claimed in claim 27, wherein a green OLED is positioned between yellow and cyan OLEDs.

31. The OLED display device claimed in claim 1, wherein the means for driving performs a conversion from an RGB signal to a device drive signal by calculation in real time.

32. The OLED display device claimed in claim 1, wherein the means for driving performs a conversion from an RGB signal to a device drive signal by referencing to a look-up table.

33. The OLED display device claimed in claim 1, wherein each pixel comprises two or more OLEDs for emitting a same color of light.

34. The OLED display device claimed in claim 33, wherein the two or more OLEDs that emit light of the same color in each pixel are additional colored OLED(s) that expand the gamut of the display device relative to the gamut defined by the red, green and blue OLEDs.

35. The OLED display device claimed in claim 33, wherein the two or more OLEDs that emit light of the same color in each pixel are one or more of the red, green or blue OLED(s).

36. The OLED display device claimed in claim 33, wherein there are more green light emitting OLEDs in each pixel than red or blue light emitting OLEDs.

37. The OLED display device claimed in claim 33, wherein there are more red light emitting OLEDs in each pixel than blue light emitting OLEDs.

38. A method of reducing the power usage of an OLED display device comprising a) an array of light emitting pixels, each pixel having red, green, and blue OLEDs and at least one additional colored OLED that expands the gamut of the display device relative to the gamut defined by the red, green and blue OLEDs, wherein the luminance efficiency or the luminance stability over time of the additional OLED is higher than the luminance efficiency or the luminance stability over time of at least one of the red, green, and blue OLEDs, and b) means for selectively driving the OLEDs with a drive signal to reduce overall power usage or extend the lifetime of the display while maintaining display color accuracy, comprising the steps of:

prioritizing all possible subgamuts which may defined by combinations of any three OLEDs of different colors within a pixel according to average efficiencies;

calculating the intensities required of the three OLEDs of each pixel which define the lowest priority subgamut that may be used to form each desired color;

successively adding any remaining more efficient OLEDs which do not make up the lowest priority subgamut to the combination of OLEDs which make up the lowest priority subgamut, and calculating the intensities required of combinations of the added OLEDs and two other of the OLEDs which define additional subgamuts which may be used to form each desired color; and selectively driving the OLEDs in each pixel with a drive signal to reduce overall power usage while maintaining display color accuracy.

* * * * *